US008866858B2

(12) United States Patent
Muto et al.

(10) Patent No.: US 8,866,858 B2
(45) Date of Patent: Oct. 21, 2014

(54) ELECTRO-OPTICAL DEVICE, DRIVING METHOD OF ELECTRO-OPTICAL DEVICE, CONTROL CIRCUIT OF ELECTRO-OPTICAL DEVICE, AND ELECTRONIC APPARATUS

(75) Inventors: Kota Muto, Suwa (JP); Masato Nishizawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 654 days.

(21) Appl. No.: 13/077,507

(22) Filed: Mar. 31, 2011

(65) Prior Publication Data

US 2011/0242147 A1 Oct. 6, 2011

(30) Foreign Application Priority Data

Apr. 5, 2010 (JP) ..... 2010-087240
May 12, 2010 (JP) ..... 2010-109943

(51) Int. Cl.
*G09G 5/10* (2006.01)
*G09G 3/34* (2006.01)

(52) U.S. Cl.
CPC ..... *G09G 3/344* (2013.01); *G09G 2300/0876* (2013.01); *G09G 2310/061* (2013.01); *G09G 2300/0842* (2013.01); *G09G 2310/04* (2013.01); *G09G 2320/103* (2013.01)
USPC ..... 345/690; 345/214

(58) Field of Classification Search
USPC ..... 345/690, 691, 211, 107, 204, 214
See application file for complete search history.

(56) References Cited

U.S. PATENT DOCUMENTS

2002/0021483 A1 2/2002 Katase
2006/0221049 A1* 10/2006 Miyasaka et al. ..... 345/107
2009/0237392 A1* 9/2009 Kajino ..... 345/214
2011/0115759 A1* 5/2011 Yamazaki ..... 345/204

FOREIGN PATENT DOCUMENTS

JP 3750565 4/2002

* cited by examiner

*Primary Examiner* — Quan-Zhen Wang
*Assistant Examiner* — Yuk Chow
(74) *Attorney, Agent, or Firm* — Maschoff Brennan

(57) ABSTRACT

An electro-optical device includes a control unit that controls a display unit having a plurality of pixels. The control unit performs a differential driving operation of performing an operation of erasing a first image component which is a part of a display image in a first display state and an operation of displaying a second image component which is a part of a display image in a second display state by selectively driving the pixels having different gray scales in the first display state and the second display state when the display unit is changed from the first display state to the second display state. The operation of erasing the first image component includes an extended erasing operation of driving a first pixel group which includes the pixels constituting the first image component and the pixels being adjacent to the first image component and surrounding the first image component.

15 Claims, 13 Drawing Sheets

EXTENSION PROCESS
P4 = P1 and P3 and P4 and P5 and P7

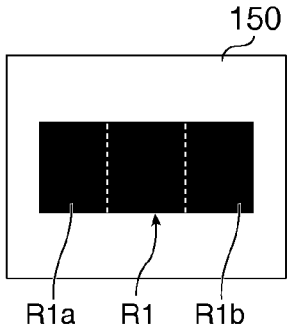
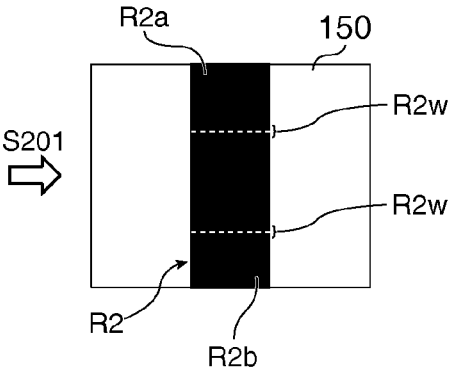
FIG. 9A FIG. 9B
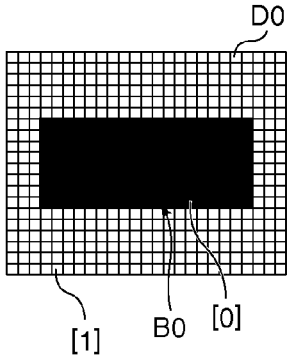
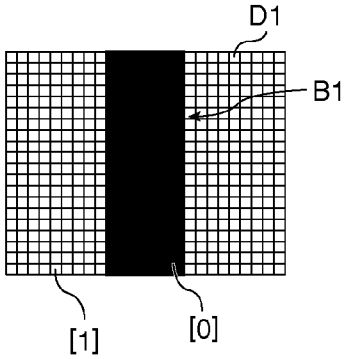
FIG. 9C FIG. 9D
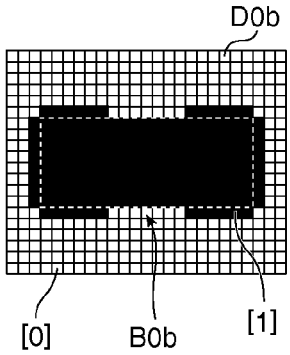
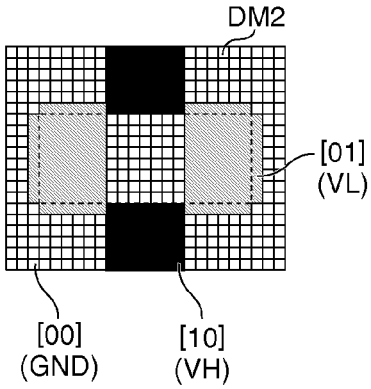
FIG. 9E FIG. 9F

ELECTRO-OPTICAL DEVICE, DRIVING METHOD OF ELECTRO-OPTICAL DEVICE, CONTROL CIRCUIT OF ELECTRO-OPTICAL DEVICE, AND ELECTRONIC APPARATUS

BACKGROUND

1. Technical Field

The present invention relates to an electro-optical device, a driving method of an electro-optical device, a control circuit of an electro-optical device, and an electronic apparatus.

2. Related Art

Memory display elements such as electrophoretic elements and electronic liquid powder (ELP) elements have been used for electro-optical devices. Such a type of electro-optical devices may employ a driving method using a memory property of a display device. For example, Japanese Patent No. 3750565 discloses a driving method of updating a display without performing a screen initializing operation (operation of causing all pixels to have the same gray scale), by applying a voltage to an electrophoretic element only during a period corresponding to a difference between a gray scale on display and a gray scale to be displayed subsequently.

However, when a display is updated by driving only the part of which the gray scale on a screen varies, there is a problem in that an afterimage is formed in the vicinity of the outline of the driven part.

SUMMARY

An advantage of some aspects of the invention is that it provides an electro-optical device, a driving method thereof, and a control circuit thereof, which can provide a high-quality display with a reduced afterimage.

According to an aspect of the invention, there is provided an electro-optical device including: a display unit in which an electro-optical material layer is interposed between a pair of substrates and a plurality of pixels are arranged; and a control unit that drives and controls the display unit. Here, the control unit performs a differential driving operation of performing an operation of erasing a first image component which is a part of a display image in a first display state and an operation of displaying a second image component which is a part of a display image in a second display state by selectively driving the pixels having different gray scales in the first display state and the second display state when the display unit is changed from the first display state to the second display state. The operation of erasing the first image component includes an extended erasing operation of driving a first pixel group which includes the pixels constituting the first image component and the pixels being adjacent to the first image component and surrounding the first image component.

According to this configuration, in the electro-optical device erasing and displaying an image component in parallel by the use of the differential driving operation, since the extended erasing operation is performed on a region including a first image component to be erased and surrounding the first image component by at least one pixel, it is possible to perform the erasing operation on the region including an afterimage-forming position along the outline of the first image component. As a result, it is possible to obtain a high-quality display with a reduced afterimage.

The extended erasing operation may be an operation of driving the pixels in a region obtained by extending the first image component to the outside by one pixel.

According to this configuration, since the erasing operation is performed on the regions interposing the outline of the first image component therebetween, it is possible to satisfactorily perform the erasing operation on the afterimage-forming position.

The control unit may perform a first differential driving operation including a selective erasing operation of selectively driving the pixels belonging to the first image component and a second differential driving operation including the extended erasing operation.

According to this configuration, since the running times of the first differential driving operation and the second differential driving operation can be set independently of each other, it is possible to set a running time (driving time of the electro-optical material layer) enough to erase an afterimage, thereby satisfactorily erasing the afterimage. Particularly, since the running time of the second differential driving operation including the extended erasing operation can also be shortened, it is possible to erase an afterimage while avoiding a problem of excessive writing or current balance accompanying the second differential driving operation.

A plurality of scanning lines and a plurality of data lines extending in directions intersecting each other may be formed in the display unit and the plurality of pixels may be arranged at positions corresponding to intersections of the plurality of scanning lines and the plurality of data lines. Here, when a period in which the plurality of scanning lines is sequentially selected once is defined as one frame, the control unit may perform the differential driving operation over a plurality of frames, perform the extended erasing operation in the differential driving operation on some frames of the plurality of frames, and perform a selective erasing operation of selectively driving the pixels belonging to the first image component in the differential driving operation on the other frames.

According to this configuration, it is possible to control the erasure of an afterimage and the load onto the electro-optical material layer depending on the number of frames.

The control unit may exclude the pixels belonging to the second image component from the first pixel group in the extended erasing operation.

According to this configuration, it is possible to prevent the display of a part of the second image component being ended due to the extended erasing operation.

More specifically, in the electro-optical device, the pixels displayed in a first gray scale and the pixels displayed in a second gray scale different from the first gray scale may be arranged in the display unit in the second display state. Here, the first image component may include the pixels that are displayed in the first gray scale in the second display state and that are displayed in a gray scale other than the first gray scale in the first display state, and the second image component may include the pixels that are displayed in the second gray scale in the second display state and that are displayed in a gray scale other than the second gray scale in the first display state.

The display unit may include memory display elements. According to this configuration, it is possible to obtain a high-quality display in memory display elements in which an afterimage is easily formed.

According to another aspect of the invention, there is provided a driving method of an electro-optical device having a display unit in which an electro-optical material layer is interposed between a pair of substrates and a plurality of pixels are arranged. Here, a display updating step of changing the display unit from a first display state to a second display state includes a differential driving step of performing an operation of erasing a first image component which is a part of a display image in the first display state and an operation of displaying a second image component which is a part of a display image in the second display state by selectively driving the pixels having different gray scales in the first display state and the second display state. The operation of erasing the first image component includes an extended erasing operation of driving a first pixel group which includes the pixels constituting the first image component and the pixels being adjacent to the first image component and surrounding the first image component.

According to this driving method, when an image component is erased and displayed in parallel by the differential driving step, since the extended erasing operation is performed on a region including a first image component to be erased and surrounding the first image component by at least one pixel, it is possible to perform the erasing operation on the region including an afterimage-forming position along the outline of the first image component. As a result, it is possible to obtain a high-quality display with a reduced afterimage.

A first differential driving step including a selective erasing operation of selectively driving the pixels belonging to the first image component and a second differential driving step including the extended erasing operation may be performed.

According to this driving method, since the running times of the first differential driving step and the second differential driving step can be set independently of each other, it is possible to set a running time (driving time of the electro-optical material layer) enough to erase an afterimage, thereby satisfactorily erasing the afterimage. Particularly, since the running time of the second differential driving step including the extended erasing operation can also be shortened, it is possible to erase an afterimage while avoiding a problem with excessive writing or current balance accompanied with the second differential driving operation.

A plurality of scanning lines and a plurality of data lines extending in directions intersecting each other are formed in the display unit and the plurality of pixels may be arranged at positions corresponding to intersections of the plurality of scanning lines and the plurality of data lines. Here, when a period in which the plurality of scanning lines are sequentially selected once is defined as one frame, the differential driving step of the display updating step may be performed over a plurality of frames, the extended erasing operation may be performed in the differential driving step over some frames of the plurality of frames, and a selective erasing operation of selectively driving the pixels belonging to the first image component may be performed in the differential driving step over the other frames.

According to this driving method, it is possible to control the erasure of an afterimage and the load onto the electro-optical material layer depending on the number of frames.

The pixels belonging to the second image component may be excluded from the first pixel group in the extended erasing operation.

According to this driving method, it is possible to prevent a part of the second image component from not being displayed due to the extended erasing operation.

According to still another aspect of the invention, there is provided a control circuit of an electro-optical device having a display unit in which an electro-optical material layer is interposed between a pair of substrates and a plurality of pixels are arranged. Here, a differential driving operation of performing an operation of erasing a first image component which is a part of a display image in a first display state and an operation of displaying a second image component which is a part of a display image in a second display state may be performed by selectively driving the pixels having different gray scales in the first display state and the second display state when the display unit is changed from the first display state to the second display state. The operation of erasing the first image component may include an extended erasing operation of driving a first pixel group which includes the pixels constituting the first image component and the pixels being adjacent to the first image component and surrounding the first image component.

According to this configuration, when erasing and displaying an image component in parallel by the use of the differential driving operation, the extended erasing operation is performed on a region including a first image component to be erased and surrounding the first image component by at least one pixel. Accordingly, it is possible to perform the erasing operation on the region including an afterimage-forming position along the outline of the first image component. As a result, it is possible to obtain a high-quality display with a reduced afterimage in the electro-optical device.

A first differential driving operation including a selective erasing operation of selectively driving the pixels belonging to the first image component and a second differential driving operation including the extended erasing operation may be performed.

According to this configuration, since the running times of the first differential driving operation and the second differential driving operation can be set independently of each other, it is possible to set a running time (driving time of the electro-optical material layer) enough to erase an afterimage, thereby satisfactorily erasing the afterimage. Particularly, since the running time of the second differential driving operation including the extended erasing operation can also be shortened, it is possible to erase an afterimage while avoiding a problem with excessive writing or current balance accompanied with the second differential driving operation.

In the control circuit which is applied to the electro-optical device in which a plurality of scanning lines and a plurality of data lines extending in directions intersecting each other may be formed in the display unit and the plurality of pixels may be arranged at positions corresponding to intersections of the plurality of scanning lines and the plurality of data lines, when a period in which the plurality of scanning lines are sequentially selected once is defined as one frame, the control unit may perform the differential driving operation over a plurality of frames, perform the extended erasing operation in the differential driving operation on some frames of the plurality of frames, and perform a selective erasing operation of selectively driving the pixels belonging to the first image component in the differential driving operation on the other frames.

According to this configuration, it is possible to control the erasure of an afterimage and the load onto the electro-optical material layer depending on the number of frames.

The pixels belonging to the second image component may be excluded from the first pixel group in the extended erasing operation.

According to this configuration, it is possible to prevent a part of the second image component from not being displayed due to the extended erasing operation.

According to yet another aspect of the invention, there is provided an electronic apparatus including the above-mentioned electro-optical device.

According to this configuration, it is possible to provide an electronic apparatus having a display unit which can provide a high-quality display with a reduced afterimage.

BRIEF DESCRIPTION OF THE DRAWINGS

The invention will be described with reference to the accompanying drawings, wherein like numbers reference like elements.

FIGS. 9A to 9F are diagrams illustrating a driving method of the electro-optical device according to the second embodiment.

DESCRIPTION OF EXEMPLARY EMBODIMENTS

Figure 1:
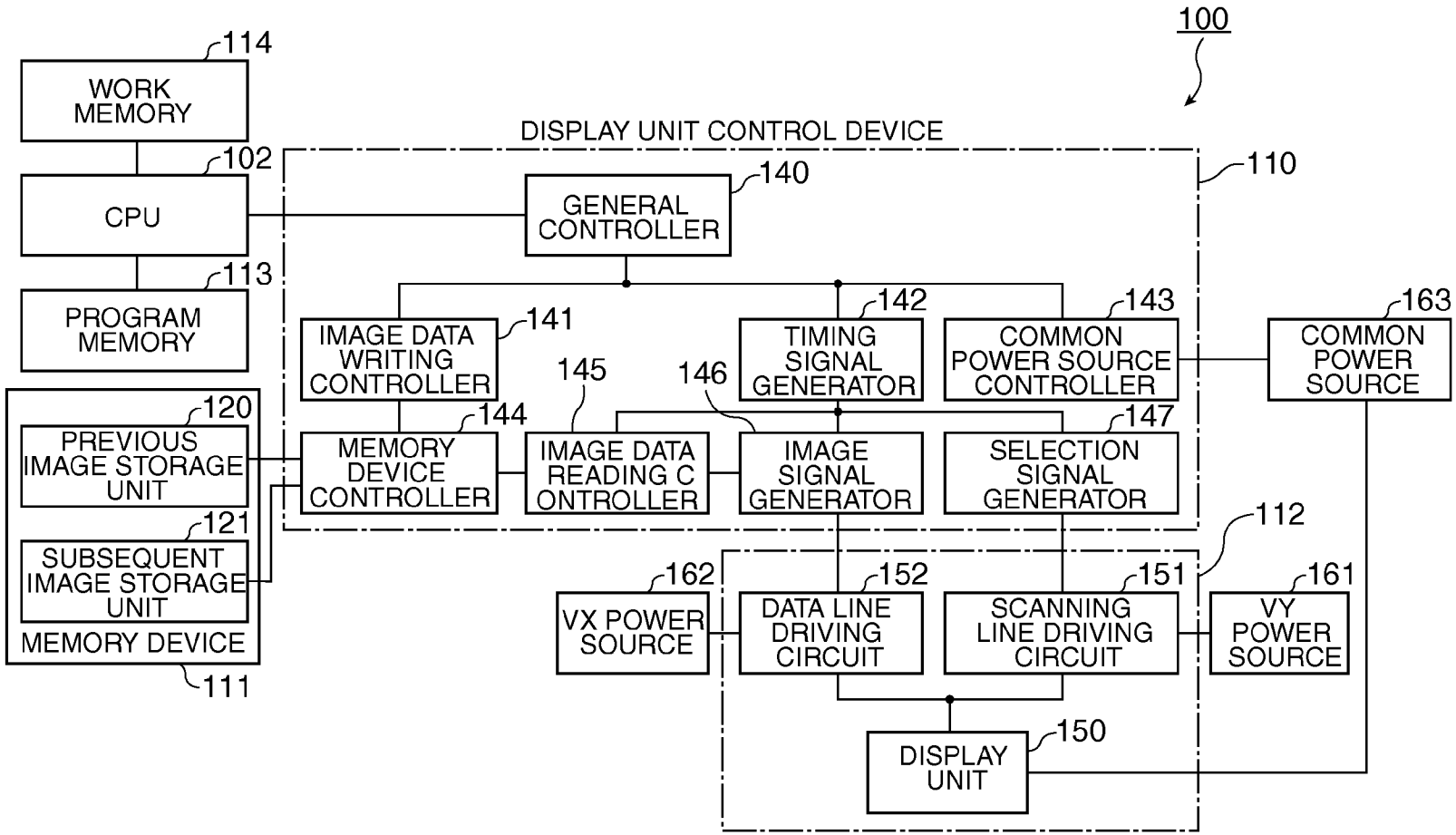
FIG. 1 is a functional block diagram illustrating the configuration of an electro-optical device according to a first embodiment of the invention.

Hereinafter, exemplary embodiments of the invention will be described with reference to the accompanying drawings.

The scope of the invention is not limited to the following embodiments, but the invention may be modified in various forms within the technical spirit of the invention. In the drawings, the scale size and the number of constituent elements are appropriately set to be different from those of the actual ones so as to facilitate recognition of the constituent elements.

First Embodiment

Figure 2:
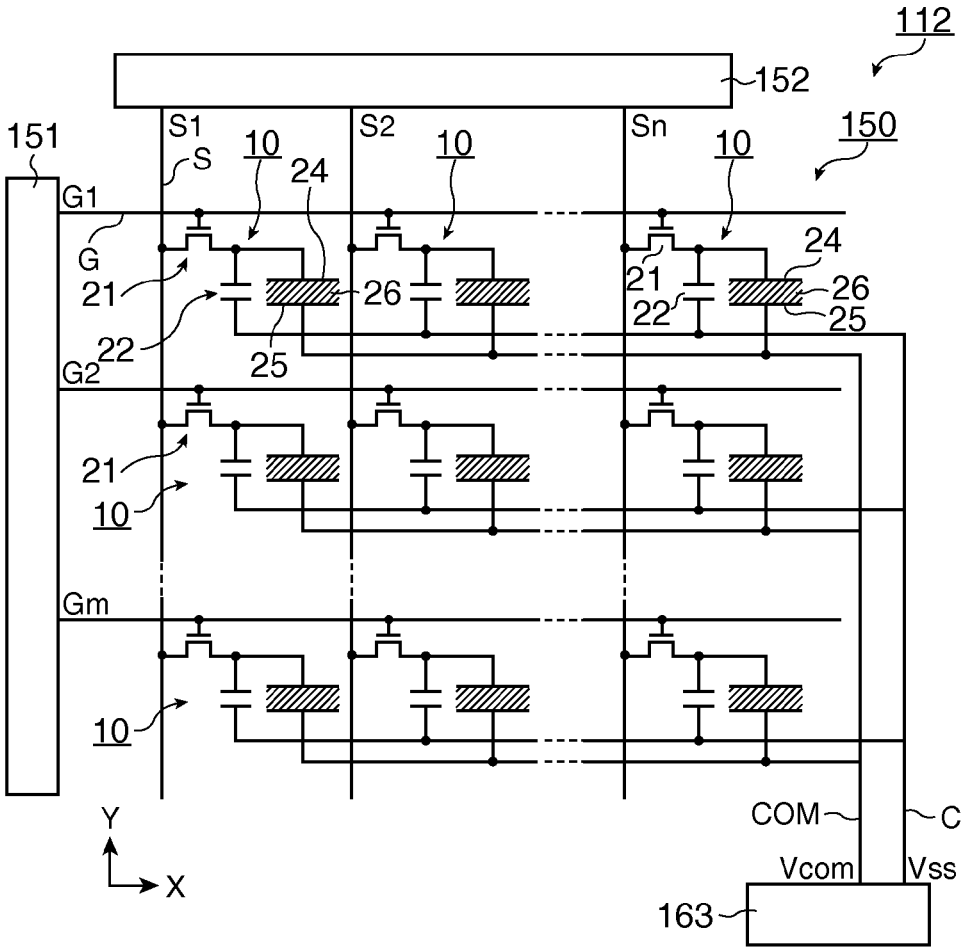
FIG. 2 is a diagram illustrating the circuit configuration of an electro-optical panel.
Figure 3A:
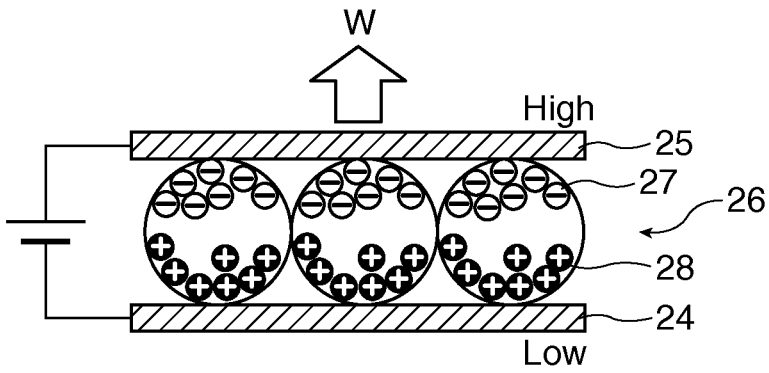
FIGS. 3A and 3B are diagrams illustrating the behavior of an electrophoretic element.
Figure 3B:
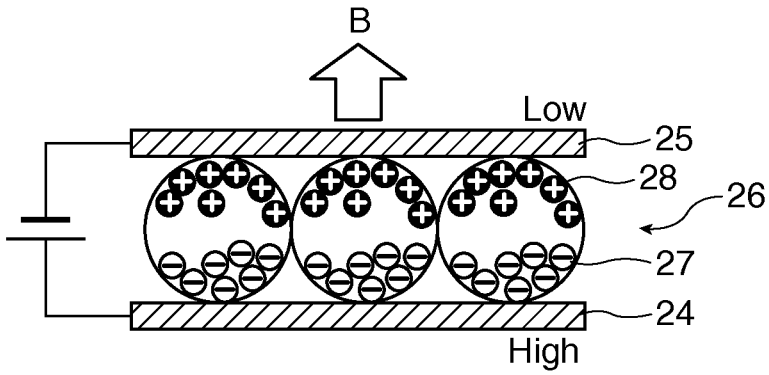

FIG. 1 is a functional block diagram illustrating an electro-optical device according to a first embodiment of the invention. FIG. 2 is a diagram illustrating the circuit configuration of an electro-optical panel. FIGS. 3A and 3B are diagrams illustrating the behavior of an electrophoretic element.

As shown in FIG. 1, an electro-optical device 100 includes a CPU (Central Processing Unit) (control unit) 102, a display unit control device 110, a memory device 111, an electro-optical panel 112, a program memory 113, a work memory 114, a VY power source 161, a VX power source 162, and a common power source 163.

The display unit control device 110, the program memory 113, and the work memory 114 are connected to the CPU 102. The memory device 111, the electro-optical panel 112, and the common power source 163 are connected to the display unit control device 110. The VY power source 161, the VX power source 162, and the common power source 163 are connected to the electro-optical panel 112.

The CPU 102 reads data and various programs such as basic control programs or application programs stored in the program memory 113 and develops the programs and the data in a work area disposed in the work memory 114 to control the units of the electro-optical device 100.

For example, when image data supplied from a high-ranked device not shown is displayed on the electro-optical panel 112, the CPU 102 generates a command to control the electro-optical panel 112 on the basis of a control signal input from the high-ranked device and outputs the command along with the image data to the display unit control device 110.

The program memory 113 is, for example, a ROM (Read Only Memory) storing various programs and the work memory 114 is a RAM (Random Access Memory) forming a work area of the CPU 102. The program memory 113 and the work memory 114 may be included in the memory device 111. Alternatively, the program memory 113 or the work memory 114 may be built in the CPU 102.

The display unit control device 110 (a control unit, a control circuit) includes a general controller 140, an image data writing controller 141, a timing signal generator 142, a common power source controller 143, a memory device controller 144, an image data reading controller 145, an image signal generator 146, and a selection signal generator 147.

The image data writing controller 141, the timing signal generator 142, and the common power source controller 143 are connected to the general controller 140. The memory device controller 144 is connected to the image data writing controller 141. The image data reading controller 145, the image signal generator 146, and the selection signal generator 147 are connected to the timing signal generator 142. The common power source 163 is connected to the common power source controller 143.

The display unit control device 110 is connected to the CPU 102 via the general controller 140, is connected to the electro-optical panel 112 via the image signal generator 146 and the selection signal generator 147, and is connected to the memory device 111 via the memory device controller 144.

The memory device 111 includes a previous image storage unit 120 and a subsequent image storage unit 121 both of which are constructed by a RAM. The previous image storage unit 120 is a memory area storing image data (image data corresponding to an image presently displayed) having been displayed on the electro-optical panel 112. The subsequent image storage unit 121 is a memory area storing image data (image data corresponding to an updated image) to be displayed subsequently on the electro-optical panel 112.

The previous image storage unit 120 and the subsequent image storage unit 121 are connected to the memory device controller 144 of the display unit control device 110. The display unit control device 110 performs operations of reading and writing image data from and to the memory device 111 via the memory device controller 144.

The electro-optical panel 112 includes a display unit 150 having memory display elements such as electrophoretic elements or cholesteric liquid crystal elements and a scanning line driving circuit 151 and a data line driving circuit 152 connected to the display unit 150. The common power source 163 is connected to the display unit 150. The VY power source 161 and the selection signal generator 147 of the display unit control device 110 are connected to the scanning line driving circuit 151. The VX power source 162 and the image signal generator 146 of the display unit control device 110 are connected to the data line driving circuit 152.

As shown in FIG. 2, plural scanning lines G (G1, G2, . . . , Gm) extending in the X axis direction of the drawing and plural data lines S (S1, S2, . . . , Sn) extending in the Y axis direction (a direction perpendicular to the X axis) are formed in the display unit 150 of the electro-optical panel 112. Pixels 10 are formed to correspond to intersections of the scanning lines G and the data lines S. The pixels 10 are arranged in a matrix shape by m pixels in the Y axis direction and n pixels in the X axis direction. The scanning lines G and the data lines S are connected to the pixels 10. Common electrode lines COM and capacitor lines C extending from the common power source 163 are formed in the display unit 150.

In each pixel 10, a selection transistor 21 as a pixel switching element, a storage capacitor 22, a pixel electrode 24, a common electrode 25, and an electro-optical material layer 26 are formed.

The selection transistor 21 is formed of an N-MOS (Negative-channel Metal Oxide Semiconductor) TFT. The gate of the selection transistor 21 is connected to a scanning line G, the source thereof is connected to a data line S, and the drain thereof is connected to one electrode of the storage capacitor 22 and the pixel electrode 24.

The storage capacitor 22 includes a pair of electrodes opposed to each other with a dielectric film interposed therebetween. One electrode of the storage capacitor 22 is connected to the drain of the selection transistor 21 and the other electrode thereof is connected to a capacitor line C. The storage capacitor 22 has a function of storing an image signal written through the selection transistor 21 for a predetermined time and maintaining the potential of the pixel electrode 24.

The electro-optical material layer 26 includes an electrophoretic element, a cholesteric liquid crystal element, an electronic liquid powder (ELP), or the like. In the electrophoretic element, for example, microcapsules in which electrophoresis particles and a dispersion medium are enclosed are arranged, or electrophoresis particles and a dispersion medium are enclosed in a space defined by barriers and a substrate.

The scanning line driving circuit 151 is connected to the scanning lines G formed in the display unit 150 and is connected to the pixels 10 in corresponding rows via the scanning lines G. The scanning line driving circuit 151 sequentially supplies a pulse-like selection signal to the scanning lines G1, G2, . . . , Gm on the basis of a timing signal supplied from the timing signal generator 142 shown in FIG. 1 via the selection signal generator 147 and sequentially switches the scanning lines G to a selected state one by one. The selected state is a state where the selection transistor 21 connected to the scanning lines G are turned on.

The data line driving circuit 152 is connected to the data lines S formed in the display unit 150 and is connected to the pixels 10 in corresponding columns via the data lines S. The data line driving circuit 152 supplies an image signal generated by the image signal generator 146 to the data lines S1, S2, . . . , Sn on the basis of a timing signal supplied from the timing signal generator 142 via the image signal generator 146.

In the following description of operations, it is assumed that the image signal has a binary potential of a high-level potential VH (for example, 15 V) or a low-level potential VL (for example, 0 V or −15 V). In this embodiment, it is also assumed that a high-level image signal (potential VH) corresponding to pixel data "0" is supplied to a pixel 10 in which block should be displayed and a low-level image signal (potential VL) corresponding to pixel data "1" is supplied to a pixel 10 in which white should be displayed.

The common electrode 25 is supplied with a potential Vcom from the common power source 163 and the capacitor lines C are supplied with a potential Vss from the common power source 163.

In the following description, it is assumed that the potential Vcom of the common electrode 25 has a binary value of a low-level potential VL (for example 0 V or −15 V) or a high-level potential VH (for example, 15 V), for the purpose of simplified explanation. It is also assumed that the potential Vss of the capacitor lines C is fixed to a reference potential GND (for example, 0 V).

As described above, various configurations can be used for the electro-optical material layer 26 in this embodiment, but it is assumed in the following description that the electro-optical material layer 26 includes electrophoretic elements, for the purpose of easier understanding of the invention.

FIGS. 3A and 3B are diagrams illustrating the behavior of electrophoretic elements, where FIG. 3A shows a state where a pixel is displayed in white and FIG. 3B shows a state where a pixel is displayed in black.

In the case of white display shown in FIG. 3A, the common electrode 25 is maintained in a relatively high potential and the pixel electrode 24 is maintained in a relatively low potential. Accordingly, negatively-charged white particles 27 are attracted to the common electrode 25 and positively-charged black particles 28 are attracted to the pixel electrode 24. As a result, as the pixel is viewed from the side of the common electrode 25 which is a display surface side, white (W) is recognized.

In the case of black display shown in FIG. 3B, the common electrode 25 is maintained in a relatively low potential and the pixel electrode 24 is maintained in a relatively high potential. Accordingly, positively-charged black particles are attracted to the common electrode 25 and negatively-charged white particles 27 are attracted to the pixel electrode 24. As a result, as the pixel is viewed from the side of the common electrode 25, black (B) is recognized.

The electro-optical panel 112 employing an active matrix system including the scanning line driving circuit 151 and the data line driving circuit 152 is exemplified in this embodiment, but an electro-optical panel employing a passive matrix system or a segment driving system may be used as the electro-optical panel 112. Other active matrix systems may be employed. For example, a 2T1C (two transistors and one capacitor) system in which each pixel includes a selection transistor, a driving transistor, and a storage capacitor and the drain of the selection transistor and one electrode of the storage capacitor are connected to the gate of the driving transistor. Alternatively, an SRAM system in which each pixel includes a latch circuit connected to the drain of the selection transistor and the connection between the pixel electrode and a control line is controlled on the basis of the output of the latch circuit may be employed. In any system, when the selection transistor is selected by the use of the scanning line, an image signal from the corresponding data line is supplied to the pixel circuit via the selection transistor and the pixel electrode has a potential corresponding to the image signal.

By employing these systems, it is possible to selectively drive some pixels 10 of the display unit 150 and to display an image using a driving method to be described later.

Figure 4:
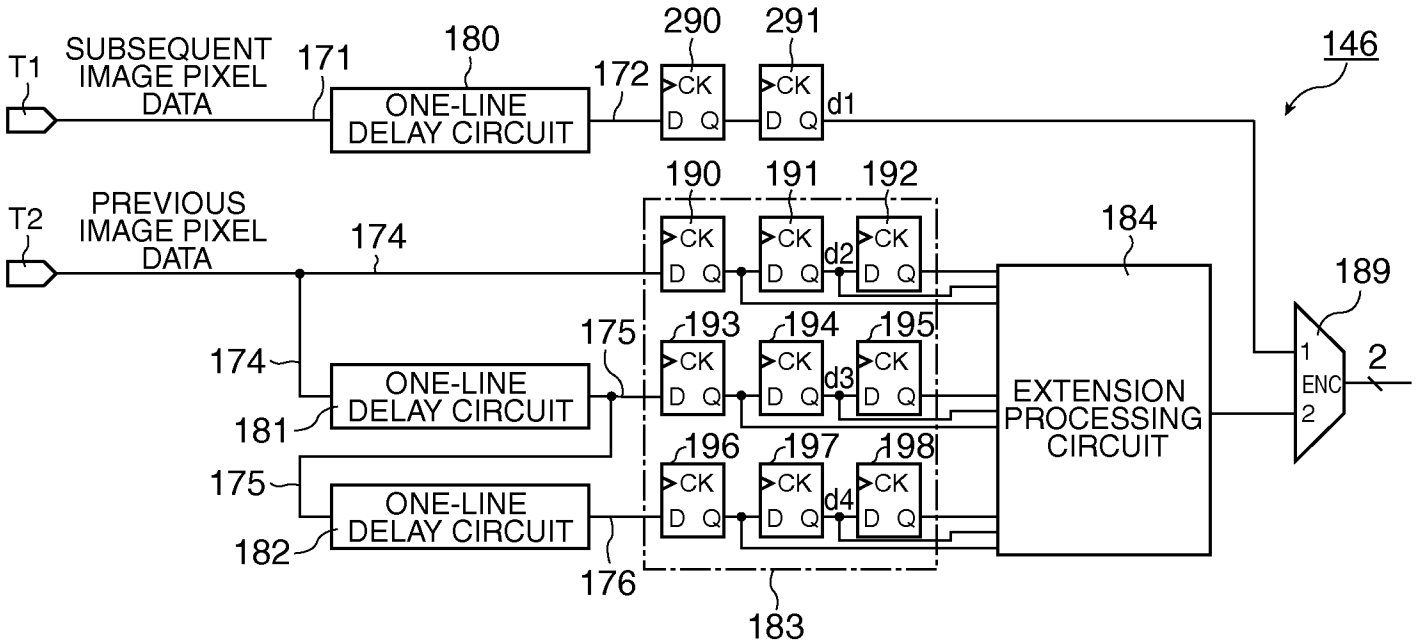
FIG. 4 is a functional block diagram illustrating the detailed configuration of an image signal generator.

FIG. 4 is a functional block diagram illustrating the detailed configuration of the image signal generator 146 (image signal generating circuit) shown in FIG. 1.

The image signal generator 146 includes one-line delay circuits 180, 181, and 182, a pixel data latch unit 183, an extension processing circuit 184, data latch circuits 290 and 291, and an encoder circuit 189.

"Subsequent image pixel data" and "previous image pixel data" are input to the image signal generator 146 from the image data reading controller 145. The "subsequent image pixel data" is pixel data constituting image data (subsequent image data) stored in the subsequent image storage unit 121 shown in FIG. 1. The "previous image pixel data" is pixel data constituting image data (previous image data) stored in the previous image storage unit 120.

The image data reading controller 145 reads the subsequent image data from the subsequent image storage unit 121 via the memory device controller 144 and reads the previous image data from the previous image storage unit 120. The corresponding pixel data (pixel data of the same address) of the subsequent image data and the previous image data are sequentially supplied to terminals T1 and T2.

The terminal T1 supplied with the "subsequent image pixel data" is connected to an input terminal of the one-line delay circuit 180 via a wire 171. The output terminal of the one-line delay circuit 180 is connected to a D input of the data latch circuit 290 which is a D flip flop. The Q output of the data latch circuit 290 is connected to a D input of the data latch circuit 291 which is a D flip flop. The Q output of the data latch circuit 291 is connected to an input terminal (input 1) of the encoder circuit 189.

On the other hand, the terminal T2 supplied with the "previous image pixel data" is connected to the pixel data latch unit 183 (the D input of the data latch circuit 190) and the one-line delay circuit 181 via a wire 174. The output terminal of the one-line delay circuit 181 is connected to the pixel data latch unit 183 (the D input of the data latch circuit 193) and the input terminal of the one-line delay circuit 182 via a wire 175. In addition, the output terminal of the one-line delay circuit 182 is connected to the pixel data latch unit 183 (the D input of the data latch circuit 196) via a wire 176. Nine output terminals of the pixel data latch unit 183 are connected to the extension processing circuit 184. The output terminal of the extension processing circuit 184 is connected to the input terminal (input 2) of the encoder circuit 189.

The one-line delay circuits 180, 181, and 182 are circuits latching the pixel data supplied via the input terminals for a predetermined period of time (selection period of the scanning lines G: one horizontal period) and then outputting the latched image data from their output terminals.

The pixel data latch unit 183 includes nine data latch circuits 190 to 198 arranged in a matrix shape of three rows and three columns. The data latch circuits 190 to 198 are D flip flops in this embodiment. The D inputs of the data latch circuits 190, 193, and 196 in the first column are the input terminals (three inputs) of the pixel data latch unit 183 and the Q outputs of the nine data latch circuits 190 to 198 are the output terminals (nine outputs) of the pixel data latch unit 183.

The data latch circuits 190 to 198, 290, and 291 are not limited to the D flip flops, but may be other circuits capable of temporarily storing the pixel data.

The encoder circuit 189 has two inputs and one output, generates a two-bit control signal (image signal) corresponding to the combination of one-bit signals (pixel data) input to two input terminals, and outputs the generated control signal to the data line driving circuit 152.

The specific operation will be described below.

First, the "subsequent image pixel data" input to the terminal T1 is input to and latched in the one-line delay circuit 180 via the wire 171 at a predetermined time. Thereafter, when a period of time corresponding to the selection period of the scanning lines G elapses, the subsequent image pixel data is input to the D input of the data latch circuit 290 via the wire 172 from the one-line delay circuit 180. Thereafter, when two clocks elapse, the subsequent image pixel data is output as pixel data d1 from the data latch circuit 291 and is input to input 1 of the encoder circuit 189.

On the other hand, at a predetermined time, the "previous image pixel data" input to the terminal T2 is first directly input to the data latch circuit 190 of the pixel data latch unit 183 via the wire 174 and is input to and latched in the one-line delay circuit 181. Thereafter, when the period of time corresponding to the selection period of the scanning lines G elapses, the previous image pixel data is input to the data latch circuit 193 of the pixel data latch unit 183 via the wire 175 from the one-line delay circuit 181 and is input to and latched in the one-line delay circuit 182. Thereafter, when the period of time corresponding to the selection period of the scanning lines G elapses, the previous image pixel data is input to the data latch circuit 196 of the pixel data latch unit 183 via the wire 176 from the one-line delay circuit 182. Accordingly, data of three continuous pixels in the same column of the previous image data are simultaneously input to three input terminals of the pixel data latch unit 183.

In this embodiment, since the pixel data is synchronously input to the terminal T1 and the terminal T2, the previous image pixel data of the position corresponding to the subsequent image pixel data is input to the data latch circuit 193 from the one-line delay circuit 181 at the same time as inputting the subsequent image pixel data to the data latch circuit 290 from the one-line delay circuit 180.

The data latch circuits in each row of the pixel data latch unit 183 are connected in series to each other in the row. That is, the Q output of the data latch circuit 190 in the first column is connected to the D input of the data latch circuit 191 in the second column, and the Q output of the data latch circuit 191 in the second column is connected to the D input of the data latch circuit 192 in the third column. Similarly, the Q output of the data latch circuit 193 is connected to the D input of the data latch circuit 194, and the Q output of the data latch circuit 194 is connected to the D input of the data latch circuit 195. The Q output of the data latch circuit 196 is connected to the D input of the data latch circuit 197 and the Q output of the data latch circuit 197 is connected to the D input of the data latch circuit 198.

According to this configuration, the pixel data input to the data latch circuits 190, 193, and 196 are transmitted to the data latch circuits 191, 194, and 197 in a subsequent stage in synchronization with a subsequent clock and are transmitted to the data latch circuits 192, 195, and 198 in a subsequent stage in synchronization with a subsequent clock. In this way, the pixel data corresponding to nine pixels arranged in a 3×3 matrix in the previous image data are sequentially latched in the pixel data latch unit 183.

The pixel data d3 output from the Q output of the data latch circuit 193 of the pixel data latch unit 183 is the previous image pixel data in the same address as the pixel data d1 output from the data latch circuit 291. The pixel data d2 is pixel data subsequent to the pixel data d3 by one row and the pixel data d4 is pixel data previous to the pixel data d3 by one row.

The nine pieces of pixel data latched in the pixel data latch unit 183 are output to the extension processing circuit 184 connected to the output terminals (the Q outputs of the nine data latch circuits 190 to 198) of the pixel data latch unit 183.

The extension processing circuit 184 is a circuit receiving the nine pieces of pixel data output from the pixel data latch unit 183 and outputting the result of a logical product of the pixel data.

Figure 5A:
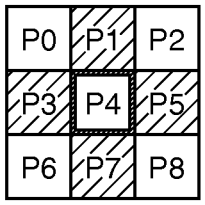
FIGS. 5A and 5B are diagrams illustrating the operation of an extension processing circuit.

Here, FIG. 5A is a diagram illustrating an operational expression used in the extension processing circuit 184. The pixel data P0 to P8 shown in FIG. 5A correspond to the data latched in the data latch circuits 190 to 198.

The extension processing circuit 184 performs its operation using the pixel data P4 (the pixel data d3 output from the data latch circuit 194) at the center as pixel data to be processed and using the pixel data P1 (pixel data d2), P3, P5, and P7 (pixel data d4) adjacent thereto and the operational expression shown in FIG. 5A.

In the extension process by the extension processing circuit 184, the operation result of a logical product (AND) of the pixel data P4 and the pixel data P1, P3, P5, and P7 adjacent thereto is output as the pixel data P4 to be processed. That is, only when all of P1, P3, P4, P5, and P7 are "1", "1" is output as the pixel data P4. Otherwise, "0" is output as the pixel data P4. In other words, when any one of P1, P3, P4, P5, and P7 is "0" (image data corresponding to the black display), "0" is output as the pixel data P4.

According to this process, the pixel data of a pixel arranged adjacent to the image component of the black display among the pixels (of which the pixel data is "1") in which white is originally displayed is changed to "0". Accordingly, by inputting the image data of one frame to the extension processing circuit 184, image data in which the outline of the image component of the black display extends to the outside from the original image data can be obtained.

The pixel data P1, P3, P5, and P7 adjacent to the pixel data P4 on the up, down, right, and left sides thereof are used in the above description, but the pixel data P0, P2, P6, and P8 adjacent to the pixel data P4 in oblique directions may be added to the operational expression. In this case, when any one of eight pieces of pixel data P0 to P3 and P5 to P8 surrounding the pixel data P4 to be processed is "0" (black display), the extension processing circuit 184 outputs "0" as the pixel data P4 to be processed. Otherwise, the extension processing circuit outputs "1".

Alternatively, the operation may be performed using only the pixel data P0, P2, P6, and P8 arranged in the oblique directions instead of the pixel data P1, P3, P5, and P7 arranged adjacent to the pixel data P4 to be processed on the up, down, right, and left sides thereof. In some cases, the operation may be performed using the pixel data arranged in a specific direction with respect to the pixel data P4 to be processed. For example, the operation may be performed using only the pixel data P3 and P5 arranged on the right and left sides of the pixel data P4 or the operation may be performed using only the pixel data P1 and P7 arranged on the up and down sides thereof.

Figure 5B:
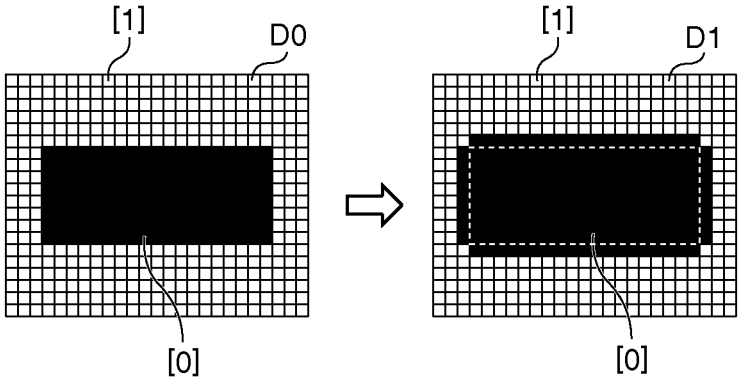

FIG. 5B is a diagram illustrating an image generated by the extension processing circuit 184.

First, the rectangular black image at the center shown on the left side of FIG. 5B exemplifies previous image data D0 previously displayed on the electro-optical panel 112. The pixel data constituting the previous image data D0 displayed in FIG. 5B are sequentially supplied to the terminal T2.

The image shown on the right side of FIG. 5B is image data D1 constituted by the pixel data output from the extension processing circuit 184. In this way, the image data D1 having an image component in which the rectangular black image of the image data D0 extends to the outside from the sides by one pixel are obtained through the use of the extension processing circuit 184.

The pixel data P4 output from the extension processing circuit 184 is supplied to input 2 of the encoder circuit 189 and the pixel data d1 output from the data latch circuit 291 is supplied to input 1 of the encoder circuit 189. The encoder circuit 189 is defined to output a control signal based on the combination of the values of input 1 and input 2. An example of the definition of the encoder circuit 189 is shown in Table 1.

TABLE 1

| | Input (input 1, input 2) | Output (2 bits) | Pixel change | Applied voltage |
|---|---|---|---|---|
| Case 1-1 | (0, 0) | [00] | Black -> Black | GND (0 V) |
| Case 1-2 | (0, 1) | [10] | White -> Black | VH (+15 V) |
| Case 1-3 | (1, 1) | [00] | White -> White | GND (0 V) |
| Case 1-4 | (1, 0) | [01] | Black -> White | VL (−15 V) |

As shown in Table 1, the encoder circuit 189 outputs an image signal having three types of values depending on the combination of the value (input 1) of the subsequent image pixel data and the value (input 2) of the previous image pixel data. The image signal output from the encoder circuit 189 is input to the data line driving circuit 152. The data line driving circuit 152 supplies the corresponding data line S with potentials (VH, VL, and GND) different depending on the value of the image signal.

Accordingly, as shown in Table 1, the operation of changing the pixels 10 in the display unit 150 from the black display to the white display and the operation of changing the pixels from the white display to the black display can be simultaneously performed.

Driving Method

The driving method of the electro-optical device 100 will be described below with reference to FIGS. 6A to 6F and FIGS. 7A to 7F.

FIGS. 6A to 6F are diagrams illustrating the state change of the display unit and the used image data in the driving method according to the first embodiment. FIGS. 7A to 7E are diagrams illustrating the state change of the display unit and the used image data in another driving method (hereinafter, referred to as a comparative driving method) for the purpose of comparison.

Figure 6A:
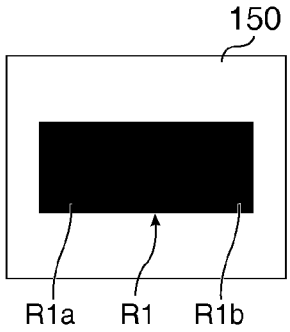
FIGS. 6A to 6F are diagrams illustrating a driving method of the electro-optical device according to the first embodiment.
Figure 6B:
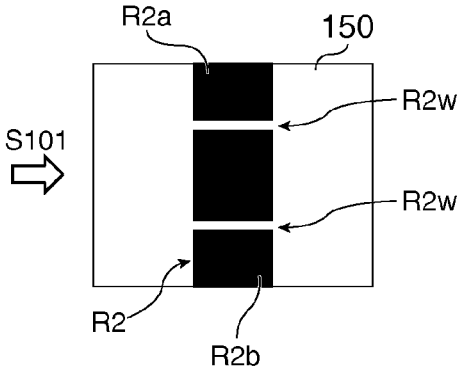

FIGS. 6A and 6B are diagrams illustrating the display state of the display unit 150.

The driving method according to this embodiment includes a differential driving step S101 which is performed at the time of changing a display state of the display unit 150 from the state (first display state) where a figure R1 shown in FIG. 6A is displayed to a display state (second display state) where a figure R2 shown in FIG. 6B is displayed.

Figure 6C:
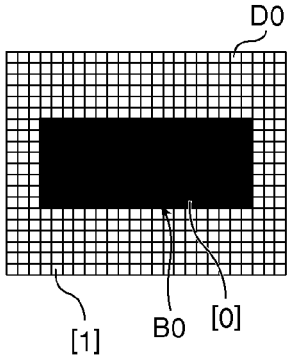
Figure 6D:
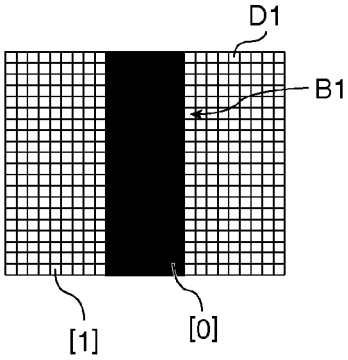
Figure 6E:
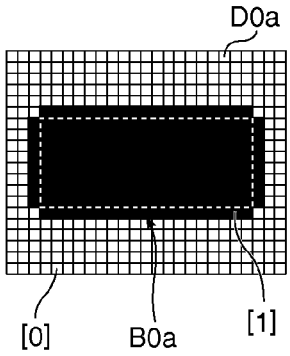
Figure 6F:
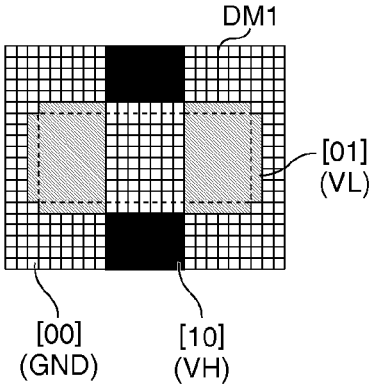

FIGS. 6C to 6F are diagrams illustrating the image data and the image signals used at the time of changing the display state from the state shown in FIG. 6A to the state shown in FIG. 6B, where FIG. 6C shows the previous image data, FIG. 6D shows the subsequent image data, FIG. 6E shows the extended image data, and FIG. 6F shows an image signal map.

In the differential driving step S101 of this embodiment, an operation of erasing the figure R1 shown in FIG. 6A and an operation of displaying the figure R2 shown in FIG. 6B are performed at the same time. More specifically, an operation of erasing the left image component R1*a* and the right image component R1*b* of the figure R1 (an operation of changing the pixels 10 from the black display state to the white display state) and an operation of displaying the upper image component R2*a* and the lower image component R2*b* of the figure R2 (an operation of changing the pixels 10 from the white display state to the black display state) are performed at the same time and the display state of the pixels 10 other than the image components R1*a*, R1*b*, R2*a*, and R2*b* is not changed.

The operations involved in performing the differential driving step S101 will be described in detail below.

When the display of the electro-optical panel 112 is updated using the driving method according to this embodiment, first, the CPU 102 transmits a panel driving request including image data (subsequent image data) to subsequently be displayed to the display unit control device 110.

The general controller 140 of the display unit control device 110 having received the panel driving request outputs the received subsequent image data (the subsequent image data D1 shown in FIG. 6D) to the image data writing controller 141. The image data writing controller 141 stores the received image data in the subsequent image storage unit 121 of the memory device 111 via the memory device controller 144. At this time, the previous image storage unit 120 stores the previous image data D0 corresponding to FIG. 6C. Thereafter, the general controller 140 performs the differential driving step S101 which is a predetermined driving sequence.

The general controller 140 outputs a command to perform the differential driving step S101 to the timing signal generator 142 and the common power source controller 143 on the basis of the panel driving request.

In the differential driving step S101 of this embodiment, a differential driving operation of inputting an image signal to the pixels 10 on the basis of the image signal map shown in FIG. 6F is performed over three frames. That is, the operation of inversely erasing some of the previous image and displaying a part of the subsequent image is repeatedly performed three times on the display unit 150 of the electro-optical panel 112.

The timing signal generator 142 outputs a command to read the previous image data D0 used in the differential driving step S101 from the previous image storage unit 120 of the memory device 111 and a command to read the subsequent image data D1 from the subsequent image storage unit 121 to the image data reading controller 145. The image data reading controller 145 acquires the previous image data D0 and the subsequent image data D1 from the previous image storage unit 120 and the subsequent image storage unit 121 via the memory device controller 144 and synchronously outputs the acquired previous image data D0 and the acquired subsequent image data D1 to the terminals T2 and T1 of the image signal generator 146 by one pixel.

Since the previous image pixel data (image data D0) input to the terminal T2 of the image signal generator 146 is subjected to the extension process by the extension processing circuit 184, the image data constituted by the pixel data supplied to input 2 of the encoder circuit 189 from the extension processing circuit 184 becomes image data D0*a* shown in FIG. 6E. In the image data D0*a*, a region B0*a* obtained by extending four sides of a region B0 in the previous image data D0 shown in FIG. 6C to the outside by one pixel is a region shown by black in which the pixel data is "0".

By this operation, the pixel data constituting the subsequent image data D1 shown in FIG. 6D are sequentially input to input 1 of the encoder circuit 189 and the pixel data constituting the image data D0*a* shown in FIG. 6E are sequentially input to input 2. Then, the encoder circuit 189 outputs image signals corresponding to the combination of the values of input 1 and input 2 in accordance with the definition shown in Table 1. FIG. 6F shows the image signal map DM1 causing the image signals output from the encoder circuit 189 to correspond to the pixel arrangement. In the image signal map DM1, the decolored part corresponds to an image signal [00], the black part corresponds to an image signal [10], and the hatched part corresponds to an image signal [01].

The image signal generator 146 outputs the image signals based on the image signal map DM1 to the data line driving circuit 152 along with the timing signal. The data line driving circuit 152 supplies the potentials corresponding to the values of the image signals to the pixels 10 via the data lines S. In this embodiment, the data line driving circuit 152 outputs a low-level potential VL (for example, −15 V) to the pixels 10 corresponding to the image signal [01] and outputs a high-level potential VH (for example, 15 V) to the pixels 10 corresponding to the image signal [10]. The data line driving circuit outputs the reference potential GND (for example, 0 V) to the pixels 10 corresponding to the image signal [00].

The selection signal generator 147 generates a selection signal necessary for the image display under the control of the timing signal generator 142 and outputs the generated selection signal to the scanning line driving circuit 151 along with the timing signal.

The common power source controller 143 outputs a command to supply the reference potential GND (for example, 0 V) to the common electrode 25 to the common power source 163.

In the electro-optical panel 112, driving voltages (the low-level potential VL, the high-level potential VH, or the reference potential GND) based on the image signal map DM1 are supplied to the pixel electrodes 24 of the pixels 10 by the scanning line driving circuit 151 having the selection signal input thereto and the data line driving circuit 152 having the image signal input thereto. The reference potential GND is input to the common electrode 25.

Then, in the regions (the hatched regions in the image signal map DM1) including the pixels 10 belonging to the image components R1*a* and R1*b* which are displayed in black in the previous image, the low-level potential VL is input to the pixel electrodes 24. Accordingly, the pixel electrodes 24 are changed to a potential lower than that of the common electrode (the reference potential GND) and the electro-optical material layer 26 (electrophoretic elements) works to display white (see FIG. 3A). By this operation, the image components R1*a* and R1*b* are displayed in the same white as the background and are erased from the display unit 150 (the operation of erasing the first image component, the extended erasing operation).

On the other hand, in the regions (black regions in the image signal map DM1) corresponding to the image components R2*a* and R2*b* in the subsequent image, the high-level potential VH is input to the pixel electrodes 24. Accordingly, the pixel electrodes 24 are changed to a potential higher than that of the common electrode 25 and the electro-optical material layer 26 works to display black (see FIG. 3B). By this operation, the black image components R2*a* and R2*b* are displayed in the display unit 150 (the operation of displaying the second image component).

In the region (the decolored region in the image signal map DM1) other than the image components R1*a*, R1*b*, R2*a*, and R2*b*, the reference potential GND is input to the pixel electrodes 24 and the same potential as the common electrode 25 is maintained. Accordingly, the electro-optical material layer 26 of the pixels 10 is not driven and thus the display thereof is not changed.

In the differential driving step S101 according to this embodiment, the image updating operation (including the operation of erasing the image components R1*a* and R1*b* and the operation of displaying the image components R2*a* and R2*b*) is repeated three times. The capacity of the storage capacitors 22 of the pixels 10 is finite and thus energy enough to cause the electro-optical material layer 26 to satisfactorily respond cannot be stored by one charging operation. Therefore, by repeatedly performing the operation of inputting the image signal (supplying the driving voltage) to the pixels 10 three times on the basis of the same image signal map DM1, the running time of the electro-optical material layer 26 can be elongated, thereby obtaining a display with a desired contrast.

In the electro-optical panel 112 according to this embodiment, the input of the image signals to the pixels 10 is performed by the use of the scanning line driving circuit 151 and the data line driving circuit 152, and the period in which all the scanning lines G are sequentially selected once is a frame (a frame period). Accordingly, the inverse erasing operation is performed over three frames.

According to the above-mentioned differential driving step S101, it is possible to update a display while preventing an afterimage formed at the time of selectively erasing the image components R1*a* and R1*b*. This operational advantage will be described in detail below by comparing the driving methods in FIGS. 6A to 6F and FIGS. 7A to 7E.

Figure 7A:
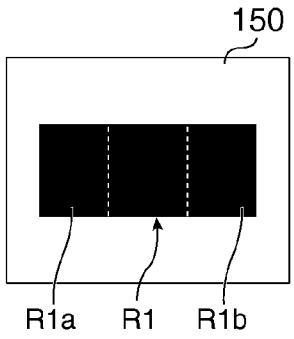
FIGS. 7A to 7E are diagrams illustrating another driving method for the purpose of comparison.
Figure 7B:
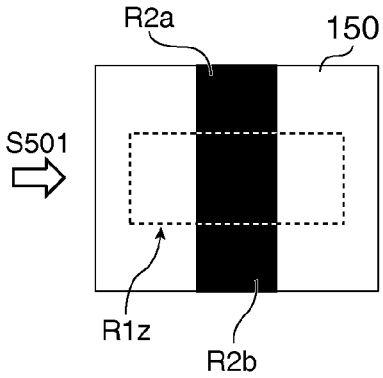
Figure 7C:
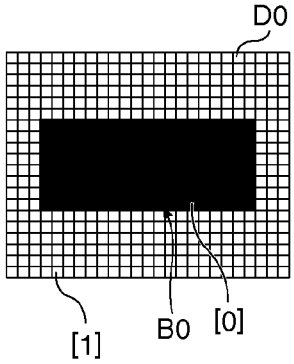
Figure 7D:
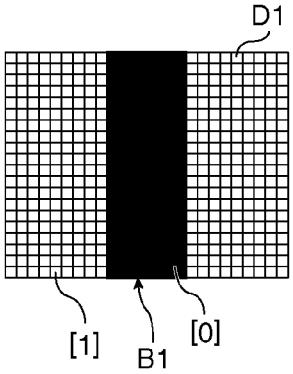
Figure 7E:
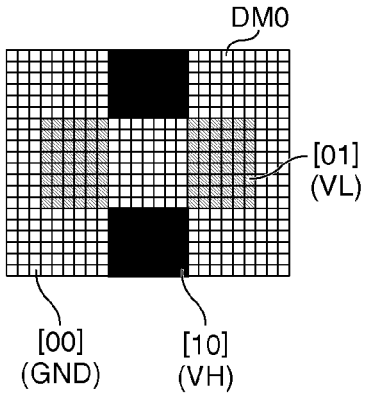

FIGS. 7A and 7B are diagrams illustrating the display state of the display unit 150 in the comparative driving method. FIGS. 7C to 7E are diagrams illustrating the image data and the image signals used at the time of changing the display state from the state shown in FIG. 7A to the state shown in FIG. 7B, where FIG. 7C shows previous image data, FIG. 7D shows subsequent image data, and FIG. 7E shows an image signal map.

The image data used in the comparative driving method includes the previous image data D0 shown in FIG. 7C and the subsequent image data D1 shown in FIG. 7D. In the comparative driving method, image signals are generated on the basis of difference data between the previous image data D0 and the subsequent image data D1 and the pixels 10 are driven by the generated image signals. Specifically, driving voltages are supplied to the pixels 10 in accordance with the image signal map DM0 shown in FIG. 7E.

By this operation, in the pixels 10 belonging to the image components R1*a* and R1*b* shown in FIG. 7A, the low-level potential VL is input to the pixel electrodes 24 and the potential of the pixel electrodes is lower than that of the common electrode 25, whereby the pixels 10 work to display white. Accordingly, the image components R1*a* and R1*b* are erased.

In the pixels 10 belonging to the image components R2*a* and R2*b* shown in FIG. 7B, the high-level potential VH is input to the pixel electrodes 24 and the potential of the pixel electrodes is higher than that of the common electrode 25, whereby the pixels 10 work to display black. Accordingly, the image components R2*a* and R2*b* are displayed in the display unit 150.

In the region other than the image components R1*a*, R1*b*, R2*a*, and R2*b*, the pixels 10 are not driven and thus the display is not changed.

By using the comparative driving method, it is also possible to change the display state from the state where the horizontally-long figure R1 shown in FIG. 7A is displayed to the state where the vertically-long figure R2 shown in FIG. 7B is displayed. However, when the comparative driving method is used, a gray line (afterimage R1*z*) is formed along the outline of the figure R1 as shown in FIG. 7B. It is thought that this is because an electric field formed between the pixel electrode 24 and the common electrode 25 has a shape more enlarged on the side of the common electrode 25 than the side of the pixel electrode 24 and the shape of the electric field varies when the polarity is inverted.

On the contrary, in the driving method according to this embodiment, as shown in FIG. 6F, the region to be driven so as to erase the image components R1*a* and R1*b* is set to the region obtained by extending the outlines of the image components R1*a* and R1*b* to the outside by one pixel. Accordingly, since the pixels 10 in the region including the position (slightly outer position of the outline of the figure R1) where the afterimage R1*z* is formed can be made to display white, it is possible to avoid the afterimage R1*z* from being formed, thereby obtaining a high-quality display in which the figure R2 is displayed in the white background without an afterimage.

In this embodiment, the region B0*a* (the region for erasing the image components R1*a* and R1*b*) in the image data D0*a* is set to the region obtained by extending the outline of the region B0 in the previous image data D0 to the outside by one pixel, but the invention is not limited to this configuration. That is, the region B0*a* may be set to a region obtained by extending the outline of the previous image data D0 to the outside by two pixels or more. In the image data D0*a*, the pixel data "0" (pixel data corresponding to the black display) may be disposed at the corners of the region B0*a* and the corners of the previous image data D0 may be extended in the oblique directions.

In this embodiment, white and black may be exchanged each other. That is, the state where the white figure R1 is displayed in a black background may be defined as the first display state, the state where the figure R2 is displayed in a black background may be defined as the second display state, and the white image components R1*a* and R1*b* are changed to black and erased and the white image components R2*a* and R2*b* may be displayed in the black background, through the use of the differential driving step S101.

This change in configuration can be applied to a second embodiment and a third embodiment to be described later without any problem.

Second Embodiment

A second embodiment of the invention will be described with reference to FIG. 8 and FIGS. 9A to 9F. In the drawings referred to by the following description, the same constituent elements as the electro-optical device 100 according to the first embodiment are referenced by the same reference numerals and detailed description thereof is not repeated.

Figure 8:
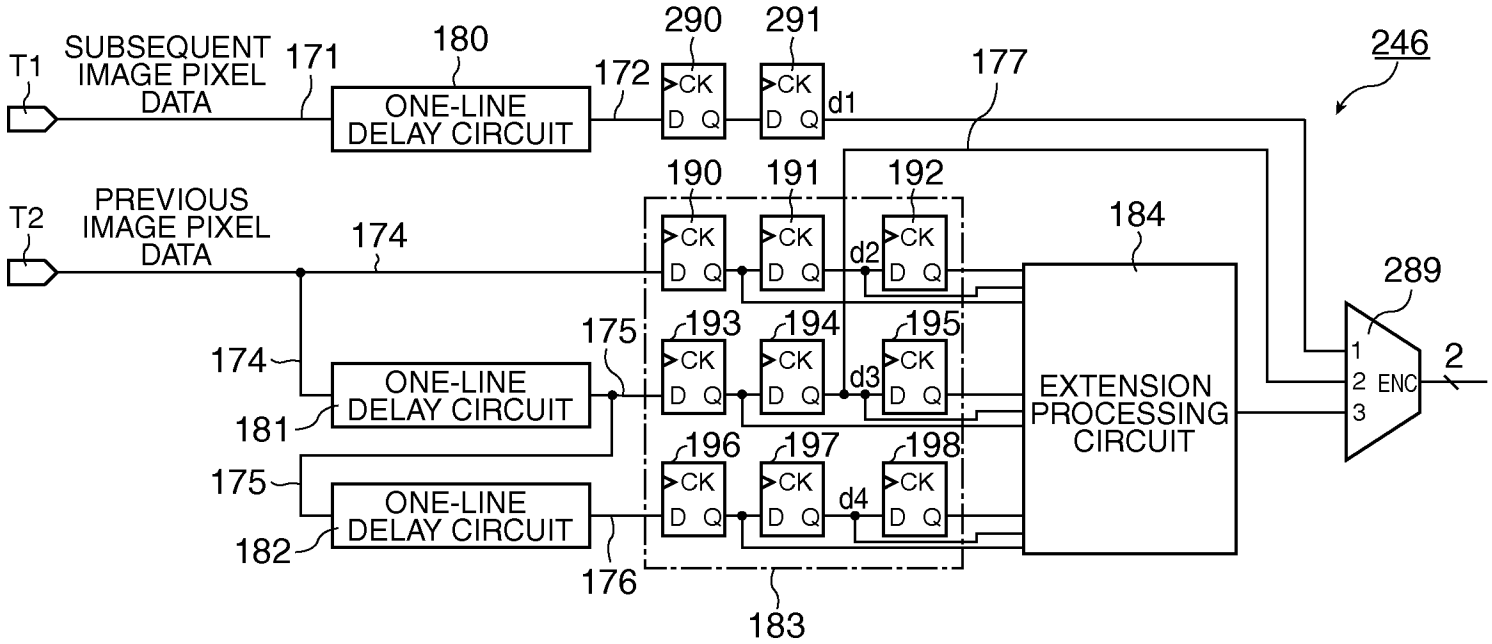
FIG. 8 is a functional block diagram illustrating an image signal generator according to a second embodiment of the invention.

FIG. 8 is a diagram illustrating the configuration of an image signal generator 246 mounted on an electro-optical device according to a second embodiment of the invention. FIGS. 9A to 9F are diagrams illustrating the state change of the display unit and the used image data in the driving method according to the second embodiment.

The image signal generator 246 shown in FIG. 8 includes terminals T1 and T2 connected to an image data reading controller 145, one-line delay circuits 180, 181, and 182, a pixel data latch unit 183, an extension processing circuit 184, data latch circuits 290 and 291, and an encoder circuit 289.

The image signal generator 246 is different from the image signal generator 146 according to the first embodiment, in that it includes the encoder circuit 289 having three inputs and one output.

Among three input terminals (input 1 to input 3) of the encoder circuit 289, the Q output of the data latch circuit 291 is connected to input 1, the Q output of the data latch circuit 194 is connected to input 2, and the output terminal of the extension processing circuit 184 is connected to input 3. That is, the subsequent image pixel data (pixel data d1) is input to input 1, the previous image pixel data (pixel data d3) not being subjected to the extension process is input to input 2, and the pixel data corresponding to the extended image data of which the outline is extended is input to input 3.

The encoder circuit 289 is defined to output a control signal based on the combination of the values of input 1 to input 3. An example of the definition of the encoder circuit 289 is shown in Table 2.

TABLE 2

| | Input (input 1, input 2, and input 3) | Output (2 bits) | Pixel change | Applied voltage |
|---|---|---|---|---|
| Case 2-1 | (0, 0, 0) | [00] | Black -> Black | GND (0 V) |
| Case 2-2 | (0, 1, 0) | [10] | White -> Black | VH (+15 V) |
| Case 2-3 | (0, 1, 1) | [10] | White -> Black | VH (+15 V) |
| Case 2-4 | (1, 1, 0) | [01] | Black -> White | VL (−15 V) |
| Case 2-5 | (1, 1, 1) | [00] | White -> White | GND (0 V) |
| Case 2-6 | (1, 0, 0) | [01] | Black -> White | VL (−15 V) |

As shown in Table 2, the encoder circuit 289 outputs an image signal having three types of values ([00], [01], and [10]) depending on the combination of the value (input 1) of the subsequent image pixel data, the value (input 2) of the previous image pixel data, and the value (input 3) of the pixel data output from the extension processing circuit 184. The image signal output from the encoder circuit 289 is input to the data line driving circuit 152. The data line driving circuit 152 supplies the corresponding data line S with potentials (VH, VL, and GND) different depending on the value of the image signal.

Accordingly, as shown in Table 2, the operation of changing the pixels 10 in the display unit 150 from the black display to the white display and the operation of changing the pixels from the white display to the black display can be simultaneously performed.

Driving Method

The driving method of the electro-optical device according to the second embodiment will be described in detail below.

FIGS. 9A and 9B are diagrams illustrating the display state of the display unit 150 in the comparative driving method. FIGS. 9C to 9F are diagrams illustrating the image data and the image signals used at the time of changing the display state from the state shown in FIG. 9A to the state shown in FIG. 9B, where FIG. 9C shows the previous image data, FIG. 9D shows the subsequent image data, FIG. 9E shows the extended image data, and FIG. 9F shows an image signal map.

In the differential driving step S201 of the second embodiment, an operation of erasing the figure R1 and an operation of displaying the figure R2 are performed at the same time. That is, an operation of erasing the left image component R1*a* and the right image component R1*b* of the figure R1 (an operation of changing the pixels 10 from the black display state to the white display state) and an operation of displaying the upper image component R2*a* and the lower image component R2*b* of the figure R2 (an operation of changing the pixels 10 from the white display state to the black display state) are performed at the same time and the display state of the pixels 10 other than the image components R1*a*, R1*b*, R2*a*, and R2*b* is not changed.

More specifically, in the differential driving step S201 according to this embodiment, the differential driving operation of inputting the image signals to the pixels 10 on the basis of the image signal map shown in FIG. 9F is performed over three frames.

In the differential driving step S201, the timing signal generator 142 outputs a command to read the previous image data D0 and the subsequent image data D1 from the memory device 111 to the image data reading controller 145. The image data reading controller 145 acquires the previous image data D0 and the subsequent image data D1 from the memory device 111 via the memory device controller 144 and synchronously outputs the acquired previous image data D0 and the acquired subsequent image data D1 to the terminals T2 and T1 of the image signal generator 246 pixel by pixel.

The subsequent image pixel data (the subsequent image data D1) input to the terminal T1 of the image signal generator 246 is adjusted in timing by the one-line delay circuit 180 and the data latch circuits 290 and 291 and is then input to input 1 of the encoder circuit 289.

The previous image pixel data input to the terminal T2 of the image signal generator 246 is input to input 2 of the encoder circuit 289 without any change via the wire 177 connecting the pixel data latch unit 183 and the encoder circuit 289, is subjected to an extension process by the extension processing circuit 184, and then input to input 3 of the encoder circuit 289.

By this operation, the pixel data constituting the subsequent image data D1 shown in FIG. 9D are sequentially input to input 1 of the encoder circuit 289, the pixel data constituting the previous image data D0 shown in FIG. 9C are sequentially input to input 2, and the pixel data constituting the image data D0*a* shown in FIG. 6E in the first embodiment are sequentially input to input 3.

The encoder circuit 289 outputs image signals corresponding to the combination of the values of input 1 to input 3 in accordance with the definition shown in Table 2. FIG. 9F shows the image signal map DM2 causing the image signals output from the encoder circuit 289 to correspond to the pixel arrangement. In the image signal map DM2, the decolored part corresponds to an image signal [00], the black part corresponds to an image signal [10], and the hatched part corresponds to an image signal [01].

The image signal generator 246 outputs the image signals based on the image signal map DM2 to the data line driving circuit 152 along with the timing signal. The data line driving circuit 152 supplies the potentials corresponding to the values of the image signals to the pixels 10 via the data lines S. In this embodiment, the data line driving circuit 152 outputs a low-level potential VL (for example, −15 V) to the pixels 10 corresponding to the image signal [01] and outputs a high-level potential VH (for example, 15 V) to the pixels 10 corresponding to the image signal [10]. The data line driving circuit outputs the reference potential GND (for example, 0 V) to the pixels 10 corresponding to the image signal [00].

The selection signal generator 147 generates a selection signal necessary for the image display under the control of the timing signal generator 142 and outputs the generated selection signal to the scanning line driving circuit 151 along with the timing signal. The common power source controller 143 outputs a command to supply the reference potential GND (for example, 0 V) to the common electrode 25 to the common power source 163.

In the electro-optical panel 112, driving voltages (the low-level potential VL, the high-level potential VH, or the reference potential GND) based on the image signal map DM2 are supplied to the pixel electrodes 24 of the pixels 10 by the scanning line driving circuit 151 having the selection signal input thereto and the data line driving circuit 152 having the image signal input thereto. The reference potential GND is input to the common electrode 25.

Accordingly, the image components R1*a* and R1*b* are displayed in the same white as the background and are erased from the display unit 150 (the operation of erasing the first image component, the extended erasing operation). In addition, the black image components R2*a* and R2*b* are displayed in the display unit 150 (the operation of displaying the second image component).

In the image signal map DM2 shown in FIG. 9F, the region to which the image signal [10] corresponding to the black part is input is widened toward the center of the image signal map DM2, compared with the image signal map DM1 shown in FIG. 6F. Accordingly, it is possible to prevent white linear regions R2*w* shown in FIG. 6B from being formed, thereby displaying the figure R2 based on the subsequent image data D1 on the display unit 150.

In the driving method according to the first embodiment, when the linear regions R2*w* are formed between the region where the figure R1 and the figure R2 overlap with each other and the image components R2*a* and R2*b*, it is because the outline of the previous image data D0 is extended uniformly by one pixel width in the image data D0*a* shown in FIG. 6E. Accordingly, the image signal [00] corresponding to the unchanged display can be allocated to the pixels 10 which originally belong to the image components R2*a* and R2*b* and to which the image signal [10] corresponding to the black display should be input.

Therefore, in this embodiment, the image signals are generated using the image data D0*b* shown in FIG. 9E. That is, the part (the second image component to be displayed in black) which is located in the white background region (the region outside the figure R1) in the previous image data D0 and which is included in the figure R2 displayed in black in the subsequent image data D1 is excluded from the range (the region obtained by extending the region B0 in the previous image data D0 to the outside by one pixel width) of the extended erasing operation.

Specifically, when the value of the pixel data (input 1) constituting the subsequent image data D1 is different from the value of the pixel data (input 2) constituting the previous image data D0 and the value of the image data (input 1) constituting the subsequent image data D1 is equal to the pixel data "0" corresponding to the black display, the encoder circuit 289 outputs the image signal [10] corresponding to the black display regardless of the value of the pixel data (input 2) constituting the image data D0*a* which is the extended image data (see Cases 2-2 and 2-3 in Table 2). Accordingly, it is possible to avoid the linear region R2*w*, which has been formed in the driving method according to the first embodiment, from being formed and thus to accurately display the subsequent image data D1.

In the differential driving step S201 according to this embodiment, the image updating operation (the operation of erasing the image components R1*a* and R1*b* and the operation of displaying the image components R2*a* and R2*b*) are performed over three frames. Accordingly, it is possible to obtain a display with desired contrast.

Third Embodiment

A third embodiment of the invention will be described with reference to FIGS. 10 and 11. In the drawings referred to by the following description, the same constituent elements as the electro-optical device 100 according to the first embodiment and the second embodiment are referenced by the same reference numerals and detailed description thereof is not repeated.

Figure 10:
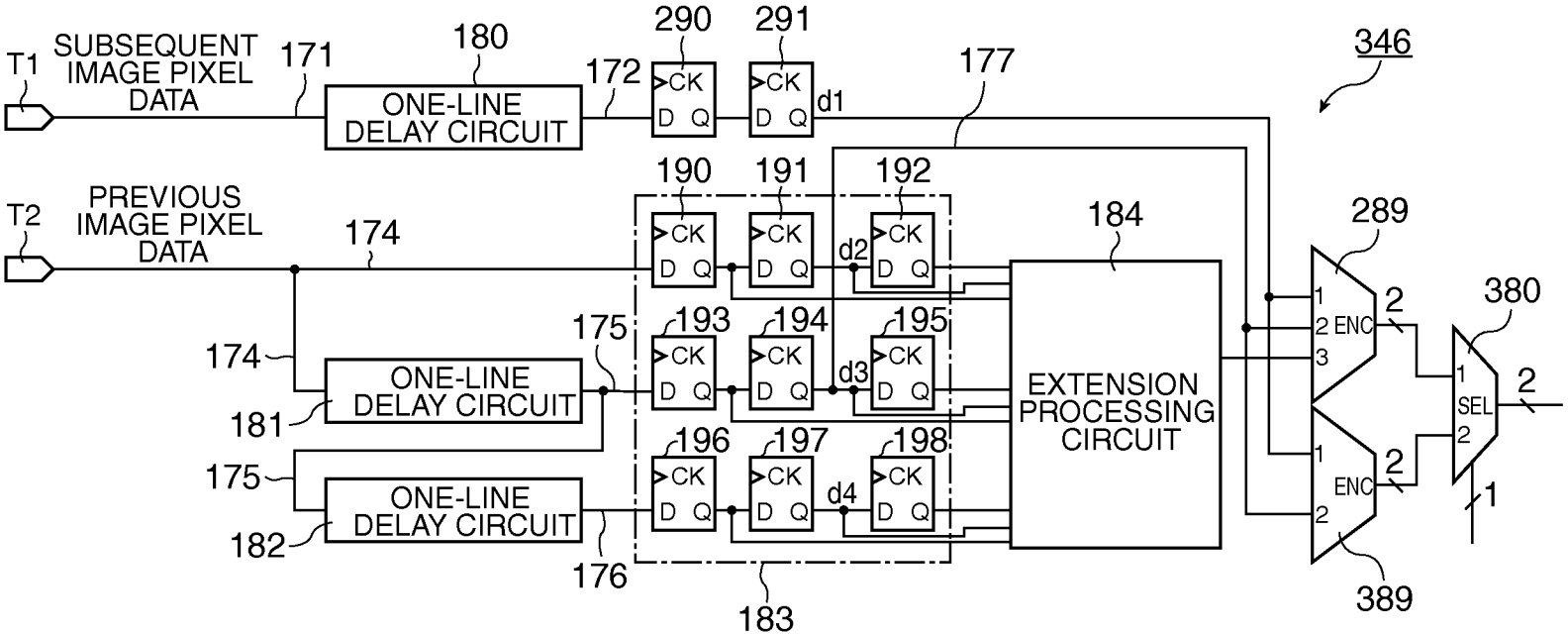
FIG. 10 is a functional block diagram illustrating an image signal generator according to a third embodiment of the invention.

FIG. 10 is a diagram illustrating the configuration of an image signal generator 346 mounted on an electro-optical device according to a third embodiment of the invention. FIG. 11 is a flow diagram illustrating the flow of a driving method according to the third embodiment. The state change of the display unit and the used image data in the third embodiment are the same as the second embodiment and thus will be described properly with reference to FIGS. 9A to 9F.

The image signal generator 346 shown in FIG. 10 includes terminals T1 and T2 connected to an image data reading controller 145, one-line delay circuits 180, 181, and 182, a pixel data latch unit 183, an extension processing circuit 184, data latch circuits 290 and 291, a first encoder circuit 289, a second encoder unit 389, and a selection circuit 380 (selector).

The image signal generator 346 has a configuration obtained by adding the second encoder circuit 389 and the selection circuit 380 having two inputs and one output to the configuration of the image signal generator 246 of the second embodiment.

Among two input terminals (input 1 and input 2) of the second encoder circuit 389, the Q output of the data latch circuit 291 is connected to input 1 and the Q output of the data latch circuit 194 is connected to input 2. That is, the subsequent image pixel data (pixel data d1) is input to input 1 and the previous image pixel data (pixel data d3) not being subjected to the extension process is input to input 2.

The output terminal of the first encoder circuit 289 is connected to input 1 of the selection circuit 380 and the output terminal of the second encoder circuit 389 is connected to input 2 of the selection circuit 380. The selection circuit 380 is a selector selecting and outputting one of input 1 and input 2 on the basis of the control signal input from the outside.

The second encoder circuit 389 is defined to output a control signal (image signal) based on the combination of the values of input 1 and input 2. An example of the definition of the second encoder circuit 389 is shown in Table 3. The definition of the first encoder circuit 289 is the same as shown in Table 2 in the second embodiment.

TABLE 3

| | Input (input 1, input 2) | Output (2 bits) | Pixel change | Applied voltage |
|---|---|---|---|---|
| Case 3-1 | (0, 0) | [00] | Black -> Black | GND (0 V) |
| Case 3-2 | (0, 1) | [10] | White -> Black | VH (+15 V) |
| Case 3-3 | (1, 1) | [00] | White -> White | GND (0 V) |
| Case 3-4 | (1, 0) | [01] | Black -> White | VL (−15 V) |

As shown in Table 3, the second encoder circuit 389 outputs an image signal having three types of values ([00], [01], and [10]) depending on only the value (input 1) of the subsequent image pixel data and the value (input 2) of the previous image pixel data. That is, the image signal map output from the second encoder circuit 389 is equal to the image signal map DM0 shown in FIG. 7E.

Accordingly, the image signal generator 346 according to the third embodiment can exchange and output the image signal based on the image signal map DM2 shown in FIG. 9F and the image signal based on the image signal map DM0 shown in FIG. 7E by the use of the selection circuit 380.

Driving Method

The driving method of the electro-optical device according to the third embodiment will be described in detail below.

Figure 11:
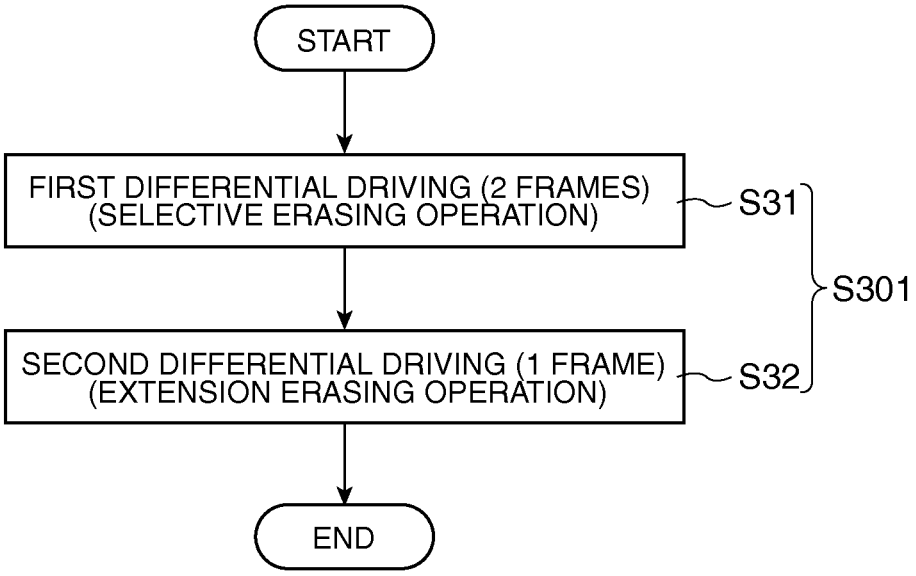
FIG. 11 is a flow diagram illustrating a driving method according to the third embodiment.

FIG. 11 is a flow diagram illustrating a differential driving step S301 according to the third embodiment of the invention. The differential driving step S301 according to this embodiment includes a first differential driving step S31 of performing a selective erasing operation as an erasing operation and a second differential driving step S32 of performing an extended erasing operation as an erasing operation.

When the display of the electro-optical panel 112 is updated using the driving method according to this embodiment, first, the CPU 102 transmits a panel driving request including image data (subsequent image data) to subsequently be displayed to the display unit control device 110.

The display unit control device 110 having received the panel driving request stores the received subsequent image data (the subsequent image data D1 shown in FIG. 9D) in the memory device 111. Thereafter, the general controller 140 performs the first differential driving step S31 and the second differential driving step S32 which are predetermined driving sequences.

First Differential Driving Step: Selective Erasing Operation

The general controller 140 outputs a command to perform the first differential driving step S31 to the timing signal generator 142 and the common power source controller 143 on the basis of the panel driving request.

In the first differential driving step S31 of this embodiment, a differential driving operation of inputting an image signal to the pixels 10 on the basis of the image signal map DM0 shown in FIG. 7E is performed over two frames.

The timing signal generator 142 outputs a control signal for selecting input 2 (the second encoder circuit 389) to the selection circuit 380 of the image signal generator 346 on the basis of the command input from the general controller 140.

The timing signal generator 142 outputs a command to read the previous image data D0 and the subsequent image data D1 used in the first differential driving step S31 from the memory device 111 to the image data reading controller 145. The image data reading controller 145 acquires the previous image data D0 and the subsequent image data D1 from the memory device 111 via the memory device controller 144 and synchronously outputs the acquired previous image data D0 and the acquired subsequent image data D1 to the terminals T2 and T1 of the image signal generator 346 by one pixel.

The subsequent image pixel data (the subsequent image data D1) input to the terminal T1 of the image signal generator 346 is input to input 1 of the second encoder circuit 389 from the data latch circuit 291.

On the other hand, the previous image pixel data (the previous image data D0) input to the terminal T2 is input to input 2 of the second encoder circuit 389 via the wire 177 from the data latch circuit 193 of the pixel data latch unit 183.

The second encoder circuit 389 outputs an image signal based on the combination of the values of inputs 1 and 2 in accordance with the definition of Table 3. The image signal map output from the second encoder circuit 389 is the same as the image signal map DM0 shown in FIG. 7E. In the image signal map DM0, the decolored part corresponds to an image signal [00], the black part corresponds to an image signal [10], and the hatched part corresponds to an image signal [01].

The image signal generator 346 outputs the image signals based on the image signal map DM0 to the data line driving circuit 152 along with the timing signal. The data line driving circuit 152 supplies the potentials corresponding to the values of the image signals to the pixels 10 via the data lines S.

The selection signal generator 147 generates a selection signal necessary for the image display under the control of the timing signal generator 142 and outputs the generated selection signal to the scanning line driving circuit 151 along with the timing signal.

The common power source controller 143 outputs a command to supply the reference potential GND (for example, 0 V) to the common electrode 25 to the common power source 163.

In the electro-optical panel 112, driving voltages (the low-level potential VL, the high-level potential VH, or the reference potential GND) based on the image signal map DM0 are supplied to the pixel electrodes 24 of the pixels 10 by the scanning line driving circuit 151 having the selection signal input thereto and the data line driving circuit 152 having the image signal input thereto. The reference potential GND is input to the common electrode 25.

In the first differential driving step S31, as shown in FIG. 11, the differential driving operation is performed over two frames. That is, the operation of inversely erasing a part of the previous image and displaying a part of the subsequent image is repeatedly performed two times on the display unit 150 of the electro-optical panel 112.

By this operation, the pixels 10 belonging to the image components R1*a* and R1*b* shown in FIG. 7A work to display white, whereby the image components R1*a* and R1*b* are erased (the operation of erasing the first image component: selective erasing operation). The pixels 10 belonging to the image components R2*a* and R2*b* shown in FIG. 7B work to display black, whereby the image components R2*a* and R2*b* are displayed on the display unit 150 (the operation of displaying the second image component).

In the region other than the image components R1*a*, R1*b*, R2*a*, and R2*b*, the pixels 10 are not driven and thus the display thereof is not changed.

The operation of the first differential driving step S31 is the same as the comparative driving method shown in FIGS. 7A to 7E. Accordingly, when the first differential driving step S31 is ended, the afterimage R1*z* shown in FIG. 7B is formed at a position along the outline of the figure R1.

Second Differential Driving Step: Extended Erasing Operation

The general controller 140 outputs a command to perform the second differential driving step S32 to the timing signal generator 142 and the common power source controller 143.

In the second differential driving step S32 of this embodiment, a differential driving operation of inputting an image signal to the pixels 10 on the basis of the image signal map DM2 shown in FIG. 9F is performed over only one frame.

The timing signal generator 142 outputs a control signal for selecting input 1 (the first encoder circuit 289) to the selection circuit 380 of the image signal generator 346 on the basis of the command input from the general controller 140.

The image data reading controller 145 acquires the previous image data D0 and the subsequent image data D1 from the memory device 111 via the memory device controller 144 in accordance with the command from the timing signal generator 142 and synchronously outputs the acquired previous image data D0 and the acquired subsequent image data D1 to the terminals T2 and T1 of the image signal generator 346 by one pixel.

The subsequent image pixel data (the subsequent image data D1) input to the terminal T1 of the image signal generator 346 is input to input 1 of the first encoder circuit 289 from the data latch circuit 291.

On the other hand, the previous image pixel data (the previous image data D0) input to the terminal T2 is input to input 2 of the first encoder circuit 289 without any change, is subjected to the extension process by the extension processing circuit 184, and is then input to input 3 of the first encoder circuit 289.

The first encoder circuit 289 outputs an image signal based on the combination of the values of inputs 1 to 3 in accordance with the definition of Table 2. The image signal map output from the first encoder circuit 289 is the same as the image signal map DM2 shown in FIG. 9F.

The image signal generator 346 outputs the image signals based on the image signal map DM2 to the data line driving circuit 152 along with the timing signal. The data line driving circuit 152 supplies the potentials corresponding to the values of the image signals to the pixels 10 via the data lines S.

The selection signal generator 147 generates a selection signal necessary for the image display under the control of the timing signal generator 142 and outputs the generated selection signal to the scanning line driving circuit 151 along with the timing signal.

The common power source controller 143 outputs a command to supply the reference potential GND (for example, 0 V) to the common electrode 25 to the common power source 163.

In the electro-optical panel 112, driving voltages (the low-level potential VL, the high-level potential VH, or the reference potential GND) based on the image signal map DM2 are supplied to the pixel electrodes 24 of the pixels 10 by the scanning line driving circuit 151 having the selection signal input thereto and the data line driving circuit 152 having the image signal input thereto. The reference potential GND is input to the common electrode 25.

Accordingly, the image components R1*a* and R1*b* shown in FIG. 9A are displayed in the same white as the background and are erased from the display unit 150 (the operation of erasing the first image component: the extended erasing operation). In addition, the black image components R2*a* and R2*b* are displayed on the display unit 150 (the operation of displaying the second image component).

In the second differential driving step S32, as shown in FIG. 9F, since the region obtained by extending the regions corresponding to the image components R1*a* and R1*b* to the outside by one pixel width is set as an erasing region, the pixels 10 in the region including the positions where the afterimage R1*z* shown in FIG. 7B is formed work to display white. Accordingly, the afterimage R1*z* formed in the first differential driving step S31 is erased.

In the electro-optical device and the driving method thereof according to the third embodiment of the invention, since the first differential driving step S31 and the second differential driving step S32 are provided as independent steps, it is possible to adjust the running times of the steps frame by frame. Particularly, since the running time of the second differential driving step S32 can be controlled in detail, it is possible to set the running time (the driving time of the electro-optical material layer 26) enough to erase the afterimage R1*z*, thereby satisfactorily erasing the afterimage.

In the electro-optical device and the driving method according to this embodiment, the running time (the number of frames) of the second differential driving step S32 is set to be shorter than the running time (the number of frames) of the first differential driving step S31. Accordingly, it is possible to satisfactorily erase the afterimage while guaranteeing the reliability of the electro-optical panel 112.

The afterimage R1*z* shown in FIG. 7B is displayed in light gray and the surrounding is displayed in white. In the second differential driving step S32, the pixels 10 in such a region work to display white, thereby erasing the after image R1*z*. At this time, when the erasing operation is performed over plural frames similarly to the first differential driving step S31, the region including the afterimage R1*z* may be more white than the surrounding, thereby forming an afterimage.

In the second differential driving step S32, since the white displaying operation is repeatedly performed on the pixels 10 not working to display black, the current history balance of the electro-optical material layer 26 may be broken, thereby shortening the lifetime of the electro-optical material layer 26 or lowering the reliability of the electro-optical panel 112.

For theses reasons, it is preferable that the running time of the second differential driving step S32 is set to be as short as possible, so long as the afterimage R1*z* can erased. Accordingly, in this embodiment, the second differential driving step S32 is performed over only one frame, whereby it is possible to erase the afterimage R1*z* while avoiding the problem with the excessive writing or the current balance.

In this embodiment, the load on the electro-optical material layer 26 is adjusted by reducing the number of frames of the second differential driving step S32, but the load on the electro-optical material layer 26 may be adjusted on the basis of the level of the driving voltage input to the pixel 10. For example, in the third embodiment, the low-level potential VL of −15 V is input to the pixel electrodes 24, but the voltage may be changed to −5 V and the second differential driving step S32 may be performed over plural frames. In this case, it is also possible to erase the afterimage R1*z* while avoiding the problem with the excessive writing or the current balance.

In the above-mentioned embodiments, the image signal generators 146, 246, and 346 built in the electro-optical device generate the image data D0*a* or the image data D0*b* used in the differential driving steps S101, S201, and S301, but the image data D0*a* and D0*b* used in the steps may be generated in advance by the use of a PC and may be stored in the program memory 113 or the like.

Electronic Apparatus

An example where the electro-optical device according to the above-mentioned embodiments is applied to an electronic apparatus will be described below.

Figure 12:
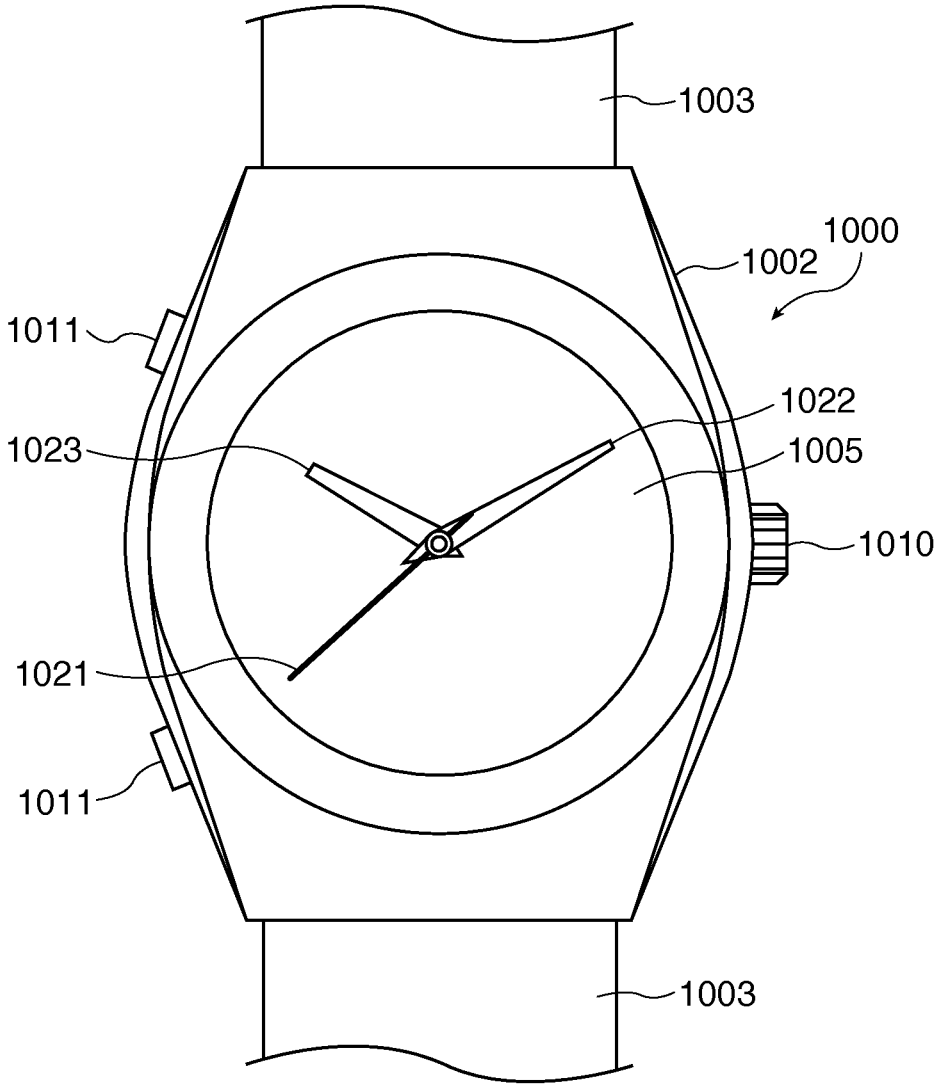
FIG. 12 is a diagram illustrating an example of an electronic apparatus.

FIG. 12 is a front view of a wristwatch 1000. The wristwatch 1000 includes a watch casing 1002 and a pair of bands 1003 connected to the watch casing 1002.

A display unit 1005 constructed by the electro-optical device according to the above-mentioned embodiments, a second hand 1021, a minute hand 1022, and an hour hand 1023 are disposed on the front surface of the watch casing 1002. A winder 1010 as an operation key and an operation button 1011 are disposed on the side surface of the watch case 1002. The winder 1010 is connected to a winding shaft (not shown) disposed in the casing and can be pulled, pushed, and rotated along with the winding shaft in plural steps (for example, two steps). A background image, text such as date or time, a second hand, a minute hand, an hour hand and the like can be displayed on the display unit 1005.

Figure 13:
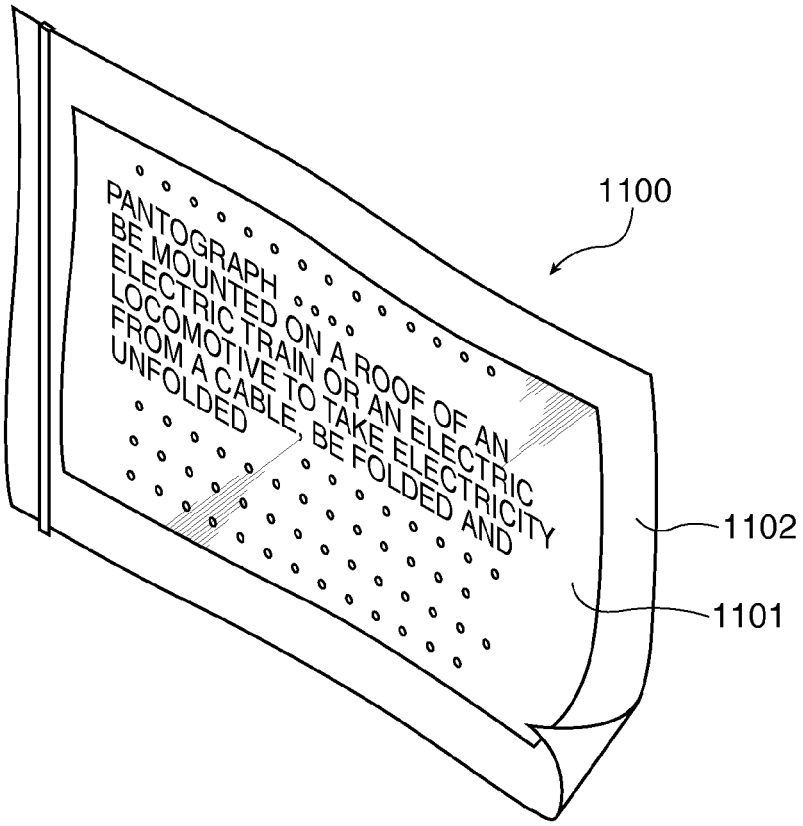
FIG. 13 is a diagram illustrating another example of an electronic apparatus.

FIG. 13 is a perspective view illustrating the configuration of an electronic paper 1100. The electronic paper 1100 includes the electro-optical device according to the above-mentioned embodiments in a display area 1101. The electronic paper 1100 also includes a flexible body 1102 formed of a rewritable sheet having the same texture and flexibility as paper.

Figure 14:
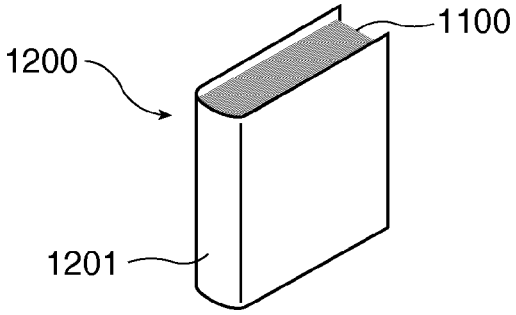
FIG. 14 is a diagram illustrating another example of an electronic apparatus.

FIG. 14 is a perspective view illustrating the configuration of an electronic notebook 1200. The electronic notebook 1200 has a configuration in which plural sheets of electronic paper 1100 are bound and interposed between covers 1201. The covers 1201 include a display data input unit (not shown) to which display data sent from an external device is input. Accordingly, the display details can be changed or updated on the basis of the display data with the sheets of electronic paper bound.

Since the wristwatch 1000, the electronic paper 1100, and the electronic notebook 1200 employ the electro-optical device according to the invention, it is possible to provide an electronic apparatus including a display unit which can display an image with high quality.

The electronic apparatuses are only examples of the electronic apparatus according to the invention and are not intended to limit the technical scope of the invention. The invention can be suitably applied to a display unit of electronic apparatuses such as a mobile phone and a portable audio apparatus.

The entire disclosure of Japanese Patent Application Nos: 2010-087240, filed Apr. 5, 2010 and 2010-109943, filed May 12, 2010 are expressly incorporated by reference herein.

What is claimed is:

1. An electro-optical device comprising:

a display unit in which an electro-optical material layer is interposed between a pair of substrates and a plurality of pixels are arranged; and a control unit that drives and controls the display unit, wherein the control unit performs a differential driving operation of performing an operation of erasing a first image component which is a part of a display image in a first display state and an operation of displaying a second image component which is a part of a display image in a second display state by selectively driving the pixels having different gray scales in the first display state and the second display state when the display unit is changed from the first display state to the second display state, and the operation of erasing the first image component includes an extended erasing operation of driving a first pixel group which includes the pixels constituting the first image component and the pixels being adjacent to the first image component and surrounding the first image component, wherein the extended erasing operation includes driving the first pixel group with a different gray scale from a first gray scale which the pixels of the first pixel group were driven during the first display state and wherein the different gray scale is also different from a second gray scale with which the pixels of the first pixel group will be driven in the second display state.

2. The electro-optical device according to claim 1, wherein the extended erasing operation is an operation of driving the pixels in a region obtained by extending the first image component to the outside by one pixel.

3. The electro-optical device according to claim 1, wherein the control unit performs a first differential driving operation including a selective erasing operation of selectively driving the pixels belonging to the first image component and a second differential driving operation including the extended erasing operation.

4. The electro-optical device according to claim 1, wherein a plurality of scanning lines and a plurality of data lines extending in directions intersecting each other are formed in the display unit and the plurality of pixels are arranged at positions corresponding to intersections of the plurality of scanning lines and the plurality of data lines, a period in which the plurality of scanning lines are sequentially selected once is defined as one frame, and the control unit performs the differential driving operation over a plurality of frames, performs the extended erasing operation in the differential driving operation on some frames of the plurality of frames, and performs a selective erasing operation of selectively driving the pixels belonging to the first image component in the differential driving operation on the other frames.

5. The electro-optical device according to claim 1, wherein the control unit excludes the pixels belonging to the second image component from the first pixel group in the extended erasing operation.

6. The electro-optical device according to claim 1, wherein the pixels displayed in a first gray scale and the pixels displayed in a second gray scale different from the first gray scale are arranged in the display unit in the second display state, the first image component includes the pixels that are displayed in the first gray scale in the second display state and that are displayed in a gray scale other than the first gray scale in the first display state, and the second image component includes the pixels that are displayed in the second gray scale in the second display state and that are displayed in a gray scale other than the second gray scale in the first display state.

7. The electro-optical device according to claim 1, wherein the display unit includes memory display elements.

8. An electronic apparatus comprising the electro-optical device according to claim 1.

9. A driving method of an electro-optical device having a display unit in which an electro-optical material layer is interposed between a pair of substrates and a plurality of pixels are arranged, the method comprising:

a display updating step of changing the display unit from a first display state to a second display state including a differential driving step of performing an operation of erasing a first image component which is a part of a display image in the first display state and an operation of displaying a second image component which is a part of a display image in the second display state by selectively driving the pixels having different gray scales in the first display state and the second display state, wherein the operation of erasing the first image component includes an extended erasing operation of driving a first pixel group which includes the pixels constituting the first image component and the pixels being adjacent to the first image component and surrounding the first image component, wherein the extended erasing operation includes driving the first pixel group with a different gray scale from a first gray scale which the pixels of the first pixel group were driven during the first display state and wherein the different gray scale is also different from a second gray scale with which the pixels of the first pixel group will be driven in the second display state.

10. The driving method according to claim 9, wherein a first differential driving step including a selective erasing operation of selectively driving the pixels belonging to the first image component and a second differential driving step including the extended erasing operation are performed.

11. The driving method according to claim 9, wherein a plurality of scanning lines and a plurality of data lines extending in directions intersecting each other are formed in the display unit and the plurality of pixels are arranged at positions corresponding to intersections of the plurality of scanning lines and the plurality of data lines, a period in which the plurality of scanning lines are sequentially selected once is defined as one frame, and the differential driving step of the display updating step is performed over a plurality of frames, the extended erasing operation is performed in the differential driving step over some frames of the plurality of frames, and a selective erasing operation of selectively driving the pixels belonging to the first image component is performed in the differential driving step over the other frames.

12. The driving method according to claim 9, wherein the pixels belonging to the second image component are excluded from the first pixel group in the extended erasing operation.

13. A control circuit of an electro-optical device having a display unit in which an electro-optical material layer is interposed between a pair of substrates and a plurality of pixels are arranged, wherein a differential driving operation of performing an operation of erasing a first image component which is a part of a display image in a first display state and an operation of displaying a second image component which is a part of a display image in a second display state is performed by selectively driving the pixels having different gray scales in the first display state and the second display state when the display unit is changed from the first display state to the second display state, and the operation of erasing the first image component includes an extended erasing operation of driving a first pixel group which includes the pixels constituting the first image component and the pixels being adjacent to the first image component and surrounding the first image component, wherein the extended erasing operation includes driving the first pixel group with a different gray scale from a first gray scale which the pixels of the first pixel group were driven during the first display state and wherein the different gray scale is also different from a second gray scale with which the pixels of the first pixel group will be driven in the second display state.

14. The control circuit according to claim 13, wherein a first differential driving operation including a selective erasing operation of selectively driving the pixels belonging to the first image component and a second differential driving operation including the extended erasing operation are performed.

15. The control circuit according to claim 13, wherein the pixels belonging to the second image component are excluded from the first pixel group in the extended erasing operation.

* * * * *